United States Patent [19]

Maruta

[11] Patent Number: 5,021,826

[45] Date of Patent: Jun. 4, 1991

[54] ELECTROPHOTOGRAPHIC COPYING MACHINE HAVING A FUNCTION OF JUDGING WHETHER A COPYING OPERATION CAN BE PERFORMED RESPONSIVE TO A REMAINDER AMOUNT OF CONSUMPTIVE PARTS OR MATERIALS

[75] Inventor: Syuzi Maruta, Osaka, Japan

[73] Assignee: Minolta Camera Kabushiki Kaisha, Osaka, Japan

[21] Appl. No.: 400,582

[22] Filed: Aug. 29, 1989

[30] Foreign Application Priority Data

Aug. 29, 1988 [JP] Japan ..... 63-214256

[51] Int. Cl.[5] ..... G03G 21/00

[52] U.S. Cl. ..... 355/205; 355/206; 355/209; 355/204

[58] Field of Search ..... 355/204, 206, 208, 209, 355/203, 205, 283, 290, 200, 202

[56] References Cited

U.S. PATENT DOCUMENTS

| | | | |
|---|---|---|---|
| 4,503,960 | 3/1985 | Koeleman et al. | 355/209 X |
| 4,535,463 | 8/1985 | Ito et al. | 377/8 |
| 4,627,715 | 12/1986 | Kikuno | 355/207 X |
| 4,687,320 | 8/1987 | Nakanishi et al. | 355/206 |
| 4,734,747 | 3/1988 | Okuda et al. | 355/206 X |
| 4,748,479 | 5/1988 | Ohira et al. | 355/207 X |
| 4,860,052 | 8/1989 | Ito et al. | 355/209 |

FOREIGN PATENT DOCUMENTS

| | | | |
|---|---|---|---|
| 61-88279 | 5/1986 | Japan . | |
| 0166574 | 7/1986 | Japan | 355/283 |
| 0159171 | 7/1987 | Japan | 355/209 |
| 0030878 | 2/1988 | Japan | 355/298 |
| 63-70862 | 3/1988 | Japan . | |
| 0276079 | 11/1988 | Japan | 355/283 |

*Primary Examiner*—A. T. Grimley
*Assistant Examiner*—William J. Royer
*Attorney, Agent, or Firm*—William, Brinks, Olds, Hofer, Gilson & Lione

[57] ABSTRACT

An electrophotographic copying machine including consumptive parts or materials which are used or consumed upon every operation is disclosed. In the copying machine, a remainder number of copies to be obtained until consumption of either one of said parts or materials reaches a predetermined value is determined, and a planned total number of copies to be obtained is estimated under copying conditions. Then, it is judged whether or not the copying operation can be completed to obtain said planned total number of copies by comparing said planned total number of copies with said remainder number of copies, and when it is judged that the completion of the copying operation is impossible, a warning is made prior to the start of the copying operation. The copying machine also has a display for displaying the number of reproducible copies and displays a half of the remainder number of copies as the reproducible number of documents when in the both sides copying mode.

3 Claims, 29 Drawing Sheets

G
S201
Return signal =1 ?
YES
NO
S2010
Waste toner full counter increment
S2012
Web counter increment
S202
Multi-copy completed ?
NO
YES
S204
SW 500 ON ?
NO
YES
S205
Developing motor ← 0
Transfer charger ← 0
Timer D set
S2020
Stop flag F1 = φ ?
NO
YES
S203
Copy start flag ← 1
S2022
Stop flag F1 ← φ
H
S211
Timer D finished ?
NO
YES
S212
Main motor ← 0
S215
Output processing
Return
H

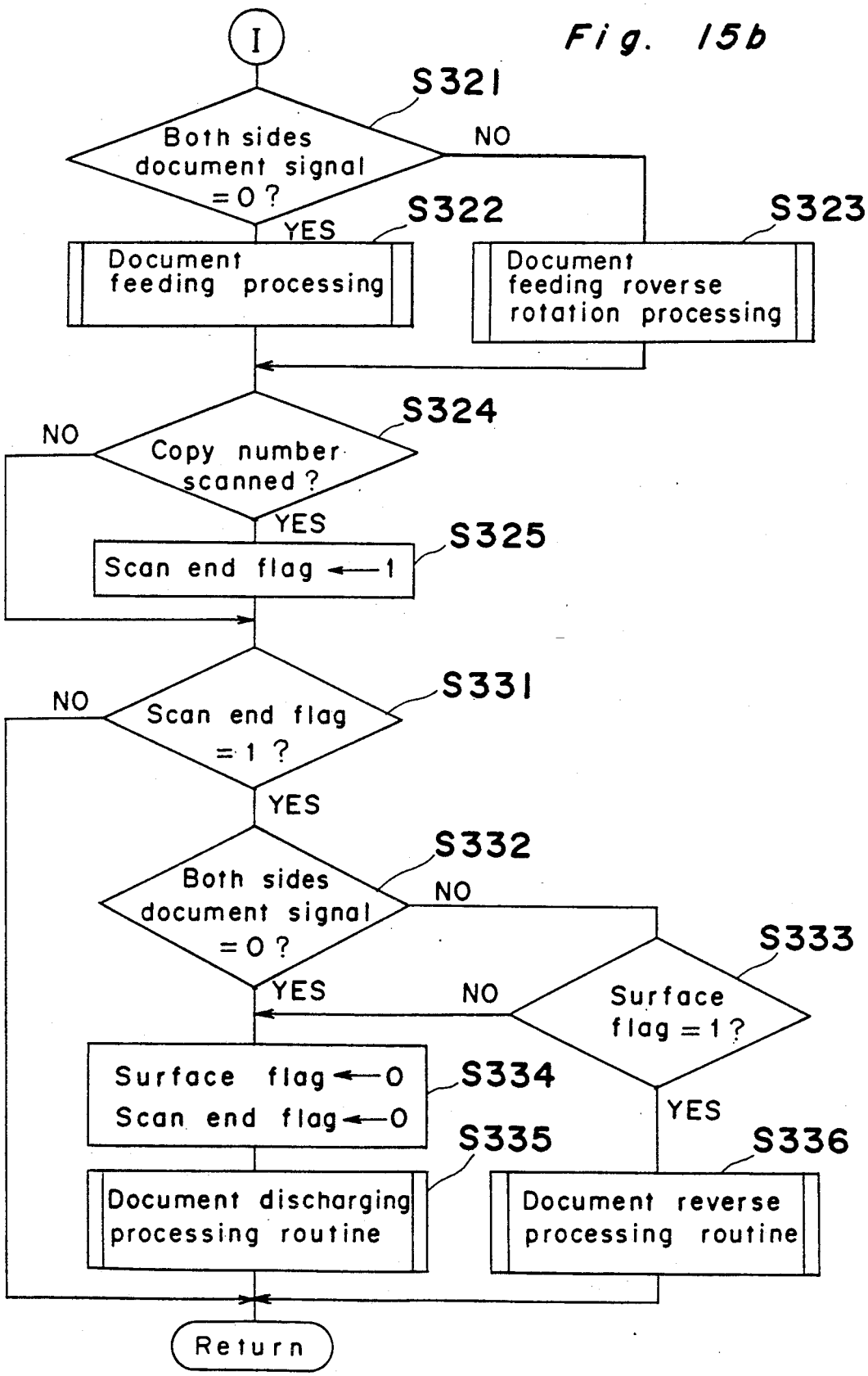
Fig. 15b
I
S321
Both sides document signal = 0 ?
NO
YES
S322
Document feeding processing
S323
Document feeding roverse rotation processing
S324
Copy number scanned ?
NO
YES
S325
Scan end flag ← 1
S331
Scan end flag = 1 ?
NO
YES
S332
Both sides document signal = 0 ?
NO
YES
S333
Surface flag = 1 ?
NO
YES
S334
Surface flag ← 0
Scan end flag ← 0
S335
Document discharging processing routine
S336
Document reverse processing routine
Return

ELECTROPHOTOGRAPHIC COPYING MACHINE HAVING A FUNCTION OF JUDGING WHETHER A COPYING OPERATION CAN BE PERFORMED RESPONSIVE TO A REMAINDER AMOUNT OF CONSUMPTIVE PARTS OR MATERIALS

BACKGROUND OF THE INVENTION

1. FIELD OF THE INVENTION

The present invention relates to an electrophotographic copying machine, and more particularly, to an electrophotographic copying machine, wherein copying operation is prohibited when consumption of either one of consumptive parts or materials which are used or consumed upon every copying operation reaches a predetermined value.

2. DESCRIPTION OF RELATED ART

A conventional electrophotographic copying machine comprises articles consumed upon every copying operation such as a cleaning web for removing waste toner adhering to a fixing roller, and a waste such as the waste toner is produced upon every copying operation. When the articles become empty or when a waste container for accommodating the waste becomes full of the waste, it is warned to the operator.

In this type of conventional copying machine, for example, there is provided a waste toner container for accommodating the waste toner produced upon every copying operation. When the weight of the waste toner container becomes larger than a predetermined value, a detecting switch is turned on, and it is displayed that the quantity of the waste toner reaches a predetermined value. Further, the copying operation is automatically suspended as soon as the quantity of the waste toner reaches a predetermined value even though it is during the copying operation.

In another conventional copying machine, there is provided a waste toner full counter for counting the number of copies obtained from an empty state of the waste toner container to a full state thereof. It is judged based on the counting value of the waste toner full counter whether or not the waste toner is to be discarded, and the copying operation is prohibited if it is judged that the waste toner is to be discarded.

In the above copying machine for detecting the timing when the waste toner should be discarded and thereby the copying operation should be prohibited, as soon as the waste toner container becomes full of the waste toner, the copying operation is suspended during the copying operation. Particularly, in the case of the copying operation for obtaining a lot of copies, the operator sets documents on a document tray of an automatic document feeder (referred to as an ADF hereinafter), and presses a start key in order to start the copying operation. Thereafter, the operator leaves the copying machine in order to do other works and returns thereto to take the copied papers and the documents around a timing when the copying operation may have been completed.

In this case, the following state may occur. Namely, after it is displayed that the waste toner container becomes full of the waste toner during the copying operation for obtaining a predetermined number of copies, for example, one thousand copies, the copying operation is suspended automatically. Thereafter, the number of copies obtained actually becomes less than the predetermined one although the copying machine has been stopped as if the copying operation has been completed.

At that time, the operator opens the front door of the copying machine, draws out the waste toner container, and discards the waste toner from the waste toner container. Then, the operator sets the waste toner container at a predetermined position of the copying machine, and presses the start key so as to start the copying operation for remaining copies.

As described above, if the waste toner container becomes full of the waste toner during the copying operation, the working efficiency upon the copying operation decreases extremely.

Incidentally, there is another type of copying machine in which a display indicative of a full state of waste is preliminarily turned on at the time when the condition of the waste container becomes not completely but substantially full of the waste and only a predetermined number of copies are permitted with turning on of the display. This type of copying machine, however, has the same drawback as mentioned above if a number of copies to be produced is larger than the permitted number of copies.

SUMMARY OF THE INVENTION

An essential object of the present invention is to provide an electrophotographic copying machine capable of previously detecting and warning prior to start of a copying operation that the copying operation will be stopped during the copying operation in order to urge the operator to execute a necessary processing for preventing the copying operation from being suspended.

Another object of the present invention is to provide an electrophotographic copying machine capable of previously detecting and warning that a waste toner container will become full of waste toner during a copying operation and that the copying operation will be suspended before completion thereof.

A further object of the present invention is to provide an electrophotographic copying machine capable of previously detecting and warning that a cleaning member will be exhausted during a copying operation and that the copying operation will be suspended before completion thereof.

A further object of the present invention is to provide a method for managing an electrophotographic copying machine, which is able to previously detect and warn that a copying operation will be suspended during a copying operation in order to urge the operator to execute a necessary processing for preventing the copying operation from being suspended.

In order to achieve the above objects, according to one aspect of the present invention, there is provided an electrophotographic copying machine, wherein copying operation is prohibited when consumption of either one of consumptive parts or materials which are used or consumed upon every copying operation reaches a predetermined value, said copying machine comprising:

- a determination means for determining a remainder number of copies to be obtained until said consumption reaches said predetermined value;
- a setting means for setting copying conditions upon performing a copying operation;
- an estimation means for estimating a planned total number of copies to be obtained under the copying conditions having been set;
- a judge means for judging whether or not the copying operation can be completed to obtain said planned total number of copies by comparing said planned total number of copies with said remainder number of copies; and a warning means for making a warning prior to the start of the copying operation when it is judged by said judge means that the completion of the copying operation is impossible.

According to another aspect of the present invention, there is provided an electrophotographic copying machine, wherein copying operation is prohibited when a waste toner container becomes full of a waste toner produced upon every copying operation, said copying machine comprising:

a determination means for determining a remainder number of copies to be obtained until said waste toner container becomes full of said waste toner;

a setting means for setting copying conditions upon performing a copying operation;

an estimation means for estimating a planned total number of copies to be obtained under the copying conditions having been set;

a judge means for judging whether or not the copying operation can be completed to obtain said planned total number of copies by comparing said planned total number of copies with said remainder number of copies; and a warning means for making a warning prior to the start of the copying operation when it is judged by said judge means that the completion of the copying operation is impossible.

According to a further aspect of the present invention, there is provided an electrophotographic copying machine, wherein copying operation is prohibited when a cleaning member consumed upon every copying operation has been exhausted, said copying machine comprising:

a determination means for determining a remainder number of copies to be obtained until said cleaning member has been exhausted;

a setting means for setting copying conditions upon performing a copying operation;

an estimation means for estimating a planned total number of copies to be obtained under the copying conditions having been set;

a judge means for judging whether or not the copying operation can be completed to obtain said planned total number of copies by comparing said planned total number of copies with said remainder number of copies; and a warning means for making a warning prior to the start of the copying operation when it is judged by said judge means that the completion of the copying operation is impossible.

According to a further aspect of the present invention, there is provided a method for managing an electrophotographic copying machine, wherein copying operation is prohibited when consumption of either one of consumptive parts or materials which are used or consumed upon every copying operation reaches a predetermined value, said method comprising:

a step for determining a remainder number of copies to be obtained until the consumption reaches said predetermined value;

a step for estimating a planned total number of copies to be obtained under copying conditions for performing a copying operation;

a step for judging whether or not the copying operation can be completed to obtain said planned total number of copies by comparing said planned total number of copies with said remainder number of copies; and a step for making a warning prior to the start of the copying operation when it is judged that the completion of the copying operation is impossible.

BRIEF DESCRIPTION OF THE DRAWINGS

These and other objects and features of the present invention will become clear from the following description taken in conjunction with the preferred embodiment thereof with reference to the accompanying drawings, in which:

FIGS. 15*a* and 15*b* are flowcharts of a document contort routine shown in FIG. 10;

DETAILED DESCRIPTION OF THE PREFERRED EMBODIMENT

An electrophotographic copying machine of a preferred embodiment according to the prevent invention will be described below in the order of the following items with reference to attached drawings.

Figure 1:
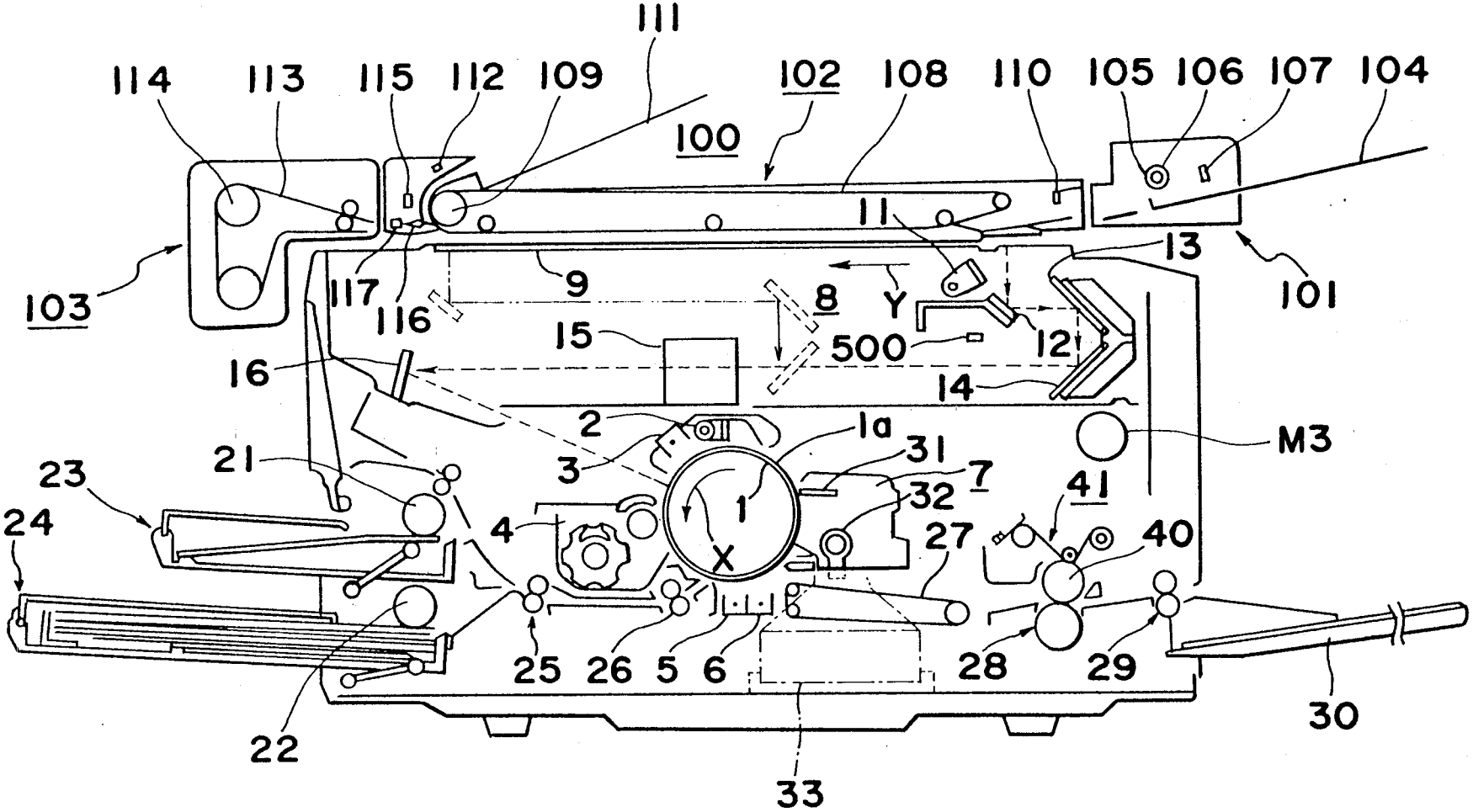
FIG. 1 is a schematic cross sectional view of an electrophotographic copying machine of a preferred embodiment according to the present invention.

(a) Composition of copying machine (b) First operation panel
(c) Second operation panel
(d) Composition of control section of copying machine
(e) Action of copying machine
(f) Document control routine
(g) Display routine
(h) Reset procedure of waste toner full counter
(i) Other modifications (a) COMPOSITION OF COPYING MACHINE FIG. 1 is a schematic cross sectional view of the electrophotographic copying machine of the preferred embodiment.

Referring to FIG. 1, a photoconductive drum 1 is arranged for rotation in the counterclockwise direction indicated by an arrow X about in the center portion of the main body of the copying machine, and also an eraser lamp 2, a corona charger 3, a developing unit 4, a corona transfer charger 5, a separating charger 6 for separating a copying paper from the photoconductive drum 1 and a blade type cleaning unit 7 are arranged around the photoconductive drum 1. A photoconductive layer 1*a* is formed on the surface of the photoconductive drum 1. After the charge of the photoconductive layer 1*a* is erased by the eraser lamp 2, the photoconductive layer 1*a* is electrified by the corona charger 3, and then, it is exposed to light projected from an optical system 8.

The optical system 8 for scanning an image of a document so as to form an electrostatic latent image thereof on the photoconductive drum 1 is arranged below a document table glass 9, and the optical system 8 is comprised of a light source 11, movable mirrors 12, 13 and 14, a focus lens 15, and a mirror 16. The light source 11 and the movable mirror 12 are moved by a scan motor M3 in the left direction as indicated by an arrow Y in FIG. 1 at a speed of v/m and also the movable mirrors 13 and 14 are moved by the scan motor M3 in the left direction at a speed of v/2m, wherein v is a rotation speed of the photoconductive drum 1 which is kept constant in both an equal magnification mode and a magnification varying mode, and m is a magnification upon copying. When the magnification is altered, the lens 15 is moved along the optical path, and also the mirror 16 is moved and swung responsive to the movement of the lens 15. Furthermore, there is provided a predetermined position switch 500 which is turned on when the above scanner is positioned at a predetermined home position.

On the left side of the main body of the copying machine, paper feeding trays 23 and 24 comprising paper feeding rollers 21 and 22, respectively, are arranged. On the way of the transportation path of the copying paper, a pair of rollers 25, a pair of timing rollers 26, a transportation belt 27, a fixing unit 28 and a pair of paper discharging rollers 29 are arranged.

Copying papers set on the paper feeding trays 23 and 24 are selectively fed to inside of the main body of the copying machine by the paper feeding rollers 21 and 22, respectively, and a copying paper picked up is transported through a pair of rollers 25 to a pair of timing rollers 26 which are stopped rotating, and then, the copying paper is positioned thereat temporarily.

Upon transferring a toner image onto a copying paper, the copying paper fed by a pair of timing rollers 26 is wound around the photoconductive drum 1 in a transfer section, and a toner image formed thereon is transferred onto the copying paper by the corona transfer charger 5. Thereafter, the copying paper is separated from the photoconductive drum 1 by the separating charger 6, and is absorbed and transported in the right direction to the fixing unit 28 by the transportation belt 27. Then, the toner image which has been transferred on the copying paper is fixed by the fixing unit 28, and the copying paper is discharged to a paper discharging tray 30 arranged outside of the main body of the copying machine by a pair of paper discharging rollers 29.

Upon the above transfer operation, waste toner remaining on the photoconductive layer 1*a* of the photoconductive drum 1 without transferring onto the copying paper is removed by the cleaning unit 7 arranged above the transportation belt 27 in the outer peripheral section of the photoconductive drum 1. The cleaning unit 7 is comprised of a cleaning blade 31, a transportation screw 32 and a waste toner container 33. The cleaning blade 31 is in contact with the photoconductive layer 1*a* of the photoconductive drum 1 so as to scratch off the waste toner adhering to the photoconductive layer 1*a*. Thereafter, the scratched toner is discharged to the waste toner container 33 by the transportation screw 32.

Furthermore, in the copying machine shown in FIG. 1, a fixing roller cleaning unit 41 for removing the toner adhering to the fixing roller 40 is provided above a pair of fixing rollers 40.

Figure 2:
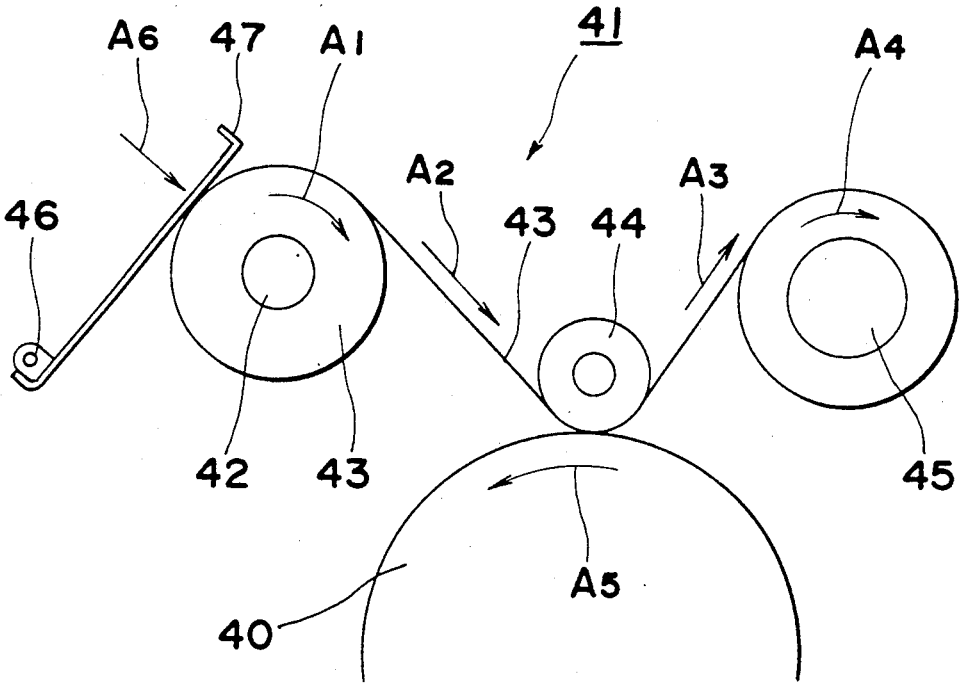
FIG. 2 is a schematic cross sectional view of a fixing roller cleaning unit of the copying machine shown in FIG. 1.

FIG. 2 shows the fixing roller cleaning unit 41.

In the fixing roller cleaning unit 41, a cleaning web 43 wound around a web roller 42 is wound up around a winding roller 45 through a pressing roller 44 as indicated by arrows A1 to A4, and the cleaning web 43 is pressed onto the fixing roller 40 rotating in a direction indicated by an arrow A5 by the pressing roller 44 so as to remove the toner adhering to the fixing roller 40. The above pressing roller 44 and the winding roller 45 are rotated by a driving motor (not shown).

The web roller 42 is arranged to be freely rotatable, and a brake is applied to the cleaning web 43 by a brake plate 47 biased in the clockwise direction as indicated by an arrow A6 in FIG. 2 around a supporting shaft 46 by a return spring (not shown) so as to prevent the cleaning web 43 from slacking.

In the fixing roller cleaning unit 41 constructed as described above, the fixing roller 40 is rotated in the direction as indicated by the arrow A5 in a state that the cleaning web 43 is in contact with the surface of the fixing roller 40 so as to clean the surface thereof. Then, the cleaning web 43 is driven for a predetermined time interval by a driving motor so as to be moved by a predetermined distance corresponding to the above image forming action. Therefore, the fixing roller 35 can be always cleaned by a new portion of the cleaning web 43.

Figure 3:
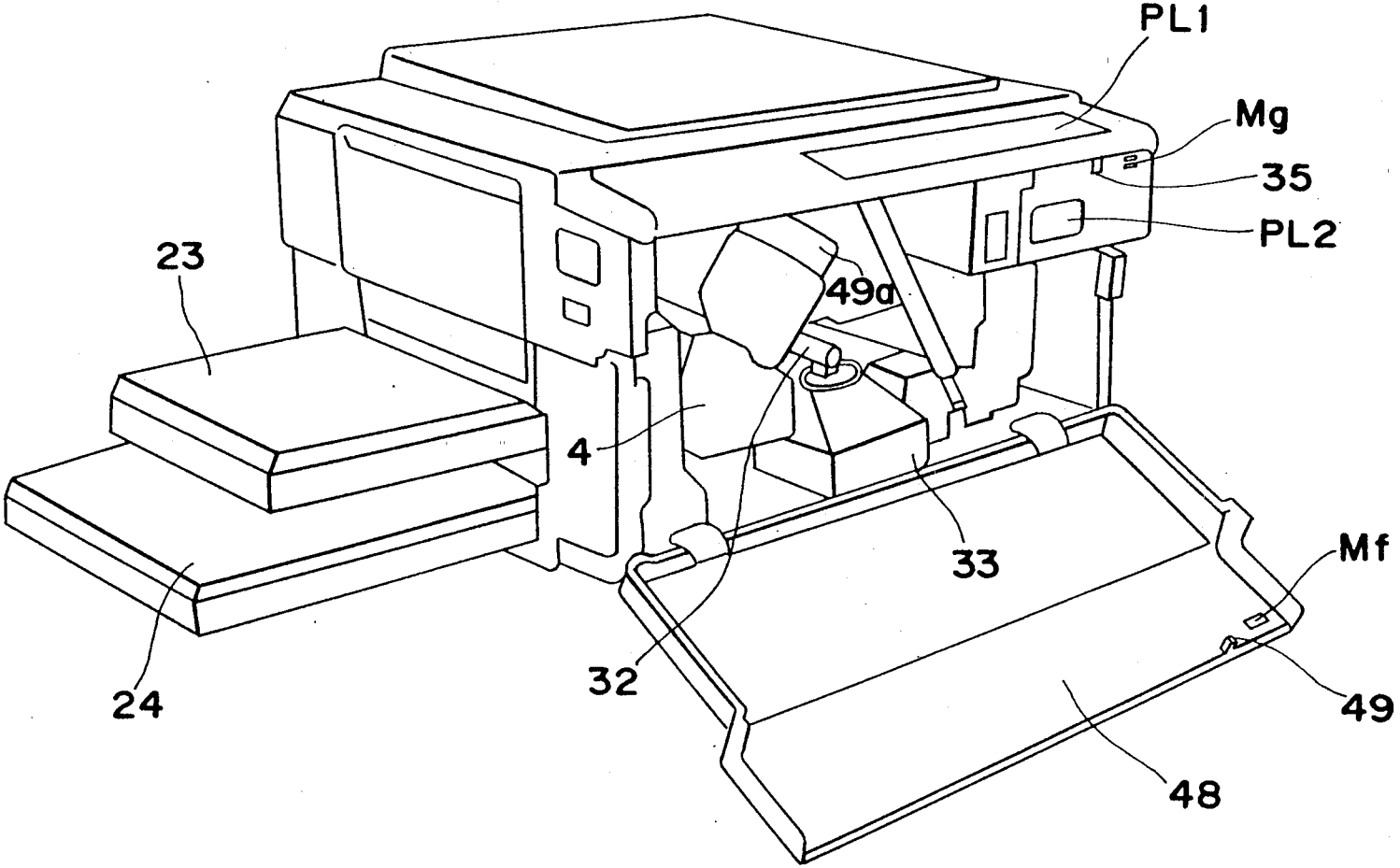
FIG. 3 is a perspective view of the copying machine shown in FIG. 1 showing a state that a front door thereof is opened.

FIG. 3 is a perspective view of the copying machine showing a state that the front door 48 of the copying machine is opened.

When a toner bottle 49*a* is exchanged with another one so as to supply toner, when the waste toner container 33 is removed and remounted, or when a processing for recovering the copying machine from a jam state or the other maintenance is performed, the front door 48 is opened. When the front door 48 is completely closed, a projected portion 49 formed on the inside surface of the front door 48 turns on a switch 35 for detecting the opening and closing states of the front door 48. On the other hand, when the front door 48 is opened, the switch 35 is turned off. Thus, the opening and closing states of the front door 48 can be detected. An iron piece Mf is mounted on the inside surface of the front door 48. When the front door 48 is completely closed, the iron piece Mf is attracted to the magnet Mg arranged in the vicinity of the switch 35 so that the front door 48 is held in the closed state.

FIG. 3 shows a state that an ADF 100 is not mounted. The ADF 100 is optional and is arranged on the main body of the copying machine. The composition of the ADF 100 will be described below referring to FIG. 1.

The ADF 100 comprises a document setting section 101, a document transportation section 102, and a document reverse section 103.

The document setting section 101 comprises a document tray 104, a document feeding roller 105, a document feeding motor 106 for driving the document feeding roller 105, and a sensor 107 for detecting a document set on the tray 104.

The document transportation section 102 is provided for setting a document fed from the document setting section 101 at a predetermined position on the document table glass 9 and discharging the document to a document discharging tray 111. The document transportation section 102 comprises a document transportation belt 108, a driving motor 109 for driving the document transportation belt 108, and a sensor 110 for detecting whether or not the document is fed thereonto. Furthermore, the document discharging tray 111 is arranged above the document transportation section 102. A sensor 112 detects whether or not the document is discharged to the document discharging tray 111.

The document reverse section 103 is provided for turning over a document on both sides of which characters are written and/or drawings are drawn (referred to as a both sides document hereinafter), and feeding it to the document transportation section 102. The document reverse section 103 comprises a transportation belt 113 and a reverse motor 114 for driving the transportation belt 113. It is switched over by a switching lever 116 operated by a solenoid 115 whether the document is discharged from the document transportation section 102 to the document discharging tray 111, or the document is fed therefrom to the document reverse section 103. A sensor 117 detects whether or not the document is fed to the document reverse section 103.

In the ADF 100 constructed as described above, a document is started to be fed in response to an ADF start signal transmitted from a control CPU 220 of the main body of the copying machine, and then, when the document is set at a predetermined position on the document table glass 9, a document predetermined position signal is transmitted to the aforementioned control CPU 220, and then, a predetermined operation is performed.

(b) FIRST OPERATION PANEL

Figure 4:
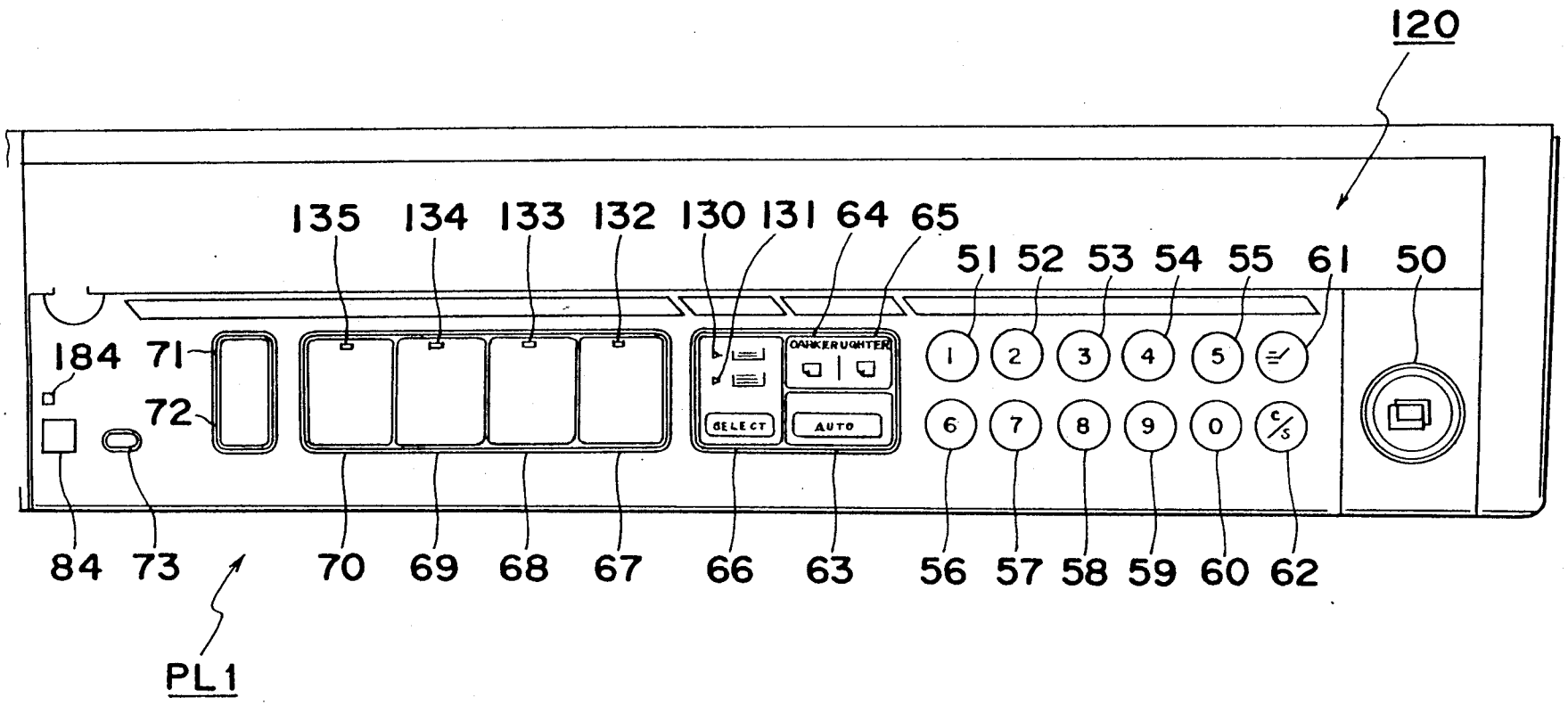
FIG. 4 is a front view of a first operation panel PL1 of the copying machine shown in FIG. 1.

FIG. 4 shows a first operation panel PL1 of the copying machine.

On the first operation panel PL1 there are provided a print key 50 for starting the copying operation of the copying machine, a set of ten keys 51 to 60 for inputting a number of copies and a number of documents, an interruption key 61, a clear/stop key 62 for clearing a set number of copies and documents etc. and stopping the copying operation, an automatic exposure key 63, and manual exposure keys 64 and 65. There are further provided a paper cassette selecting key 66 for selecting either paper feeding tray 23 or 24 so as to turn on a light emitting diode (referred to as an LED hereinafter) 130 or 131 corresponding to the selected paper feeding tray 23 or 24, and a both sides document key 67 for selecting a both sides copying mode for copying both sides of the document. When the both sides copying mode is selected, the LED 132 is turned on.

Furthermore, there are provided a copying magnification selecting key 68 for selecting an equal magnification mode, a copying magnification selecting key 69 for selecting a fixed reduction mode, and a copying magnification selecting key 70 for selecting a fixed magnification mode. When the keys 68, 69 and 70 are pressed, the LEDs 133, 134 and 135 are turned on, respectively.

Moreover, there are provided a magnification up key 71 for increasing the magnification for copying stepwise, a magnification down key 72 for decreasing the magnification for copying stepwise, a counting display request key 73 for displaying a counting values for the premaintenance in order, and a document number input mode key 84. When the key 84 is pressed, the LED 184 is turned on, and the operation mode of the copying machine enters a document number input mode.

Figure 5:
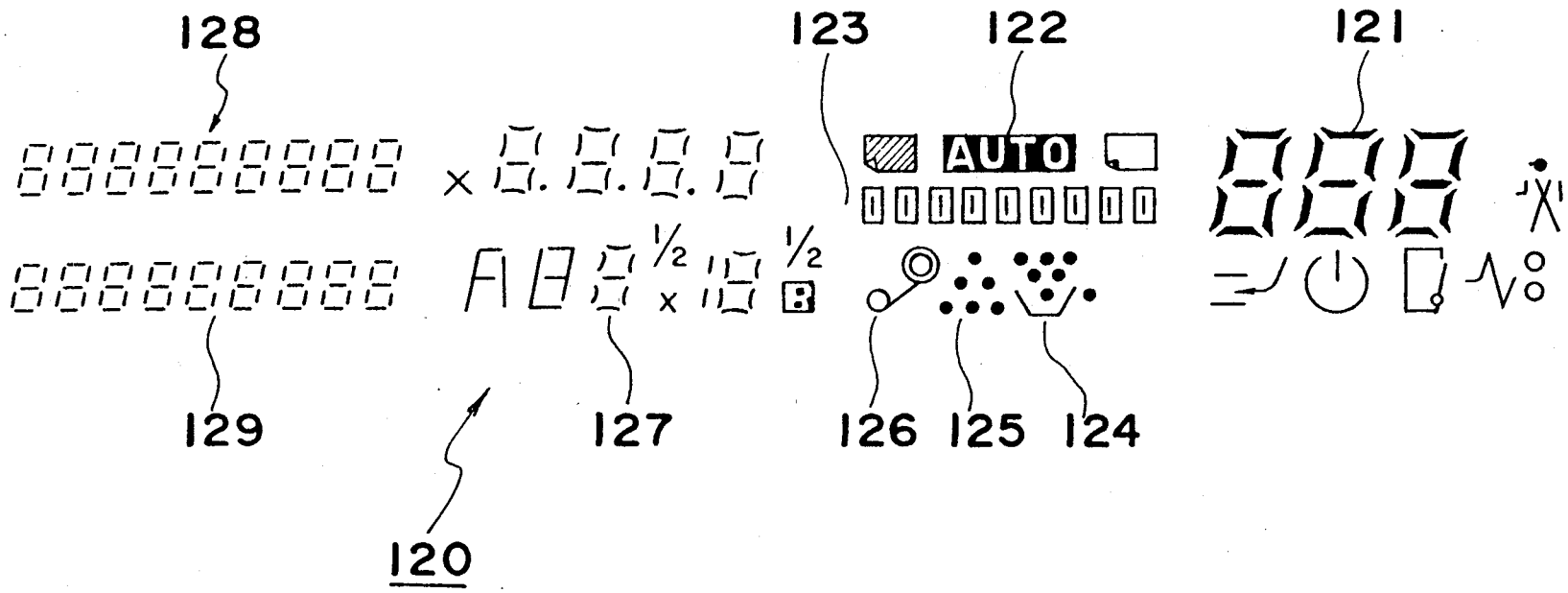
FIG. 5 is a view of a fluorescent display arranged on the first operation panel PL1 shown in FIG. 4.

FIG. 5 shows a fluorescent display section 120 arranged on the first operation panel PL1.

The fluorescent display 121 for displaying a number of copies or documents, a display 122 for the automatic exposure operation, a display 123 for the manual exposure operation, a waste toner full display 124, a toner empty display 125, a web empty display 126, a paper size display 127, a seven-segment display 128 for displaying a number of copies for a time interval until the copying operation is prohibited after the waste toner container 33 becomes full of the waste toner and a seven-segment display 129 for displaying a number of copies until the copying operation is prohibited when the fixing web has been consumed completely.

(c) SECOND OPERATION PANEL

Figure 6:
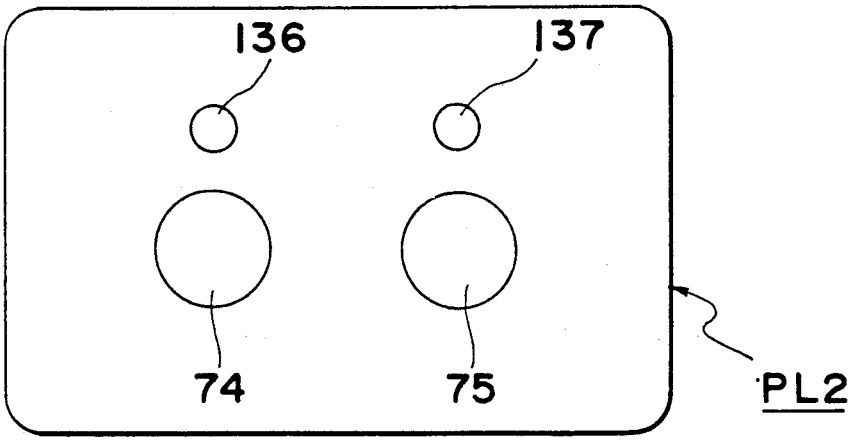
FIG. 6 is a front view of a second operation panel PL2 of the copying machine shown in FIG. 1.

FIG. 6 shows a second operation panel PL2 arranged inside of the front door 48 as shown in FIG. 3.

On the second operation panel PL2, there are provided a mode key 74 for specifying a clearing mode for clearing a waste toner full counter, an LED 136 which is turned on in the clearing mode of the waste toner full counter, a mode key 75 for specifying a clearing mode for clearing a fixing web counter, and an LED 137 which is turned on in the clearing mode of the fixing web counter.

(d) COMPOSITION OF CONTROL SECTION OF COPYING MACHINE

Figure 7:
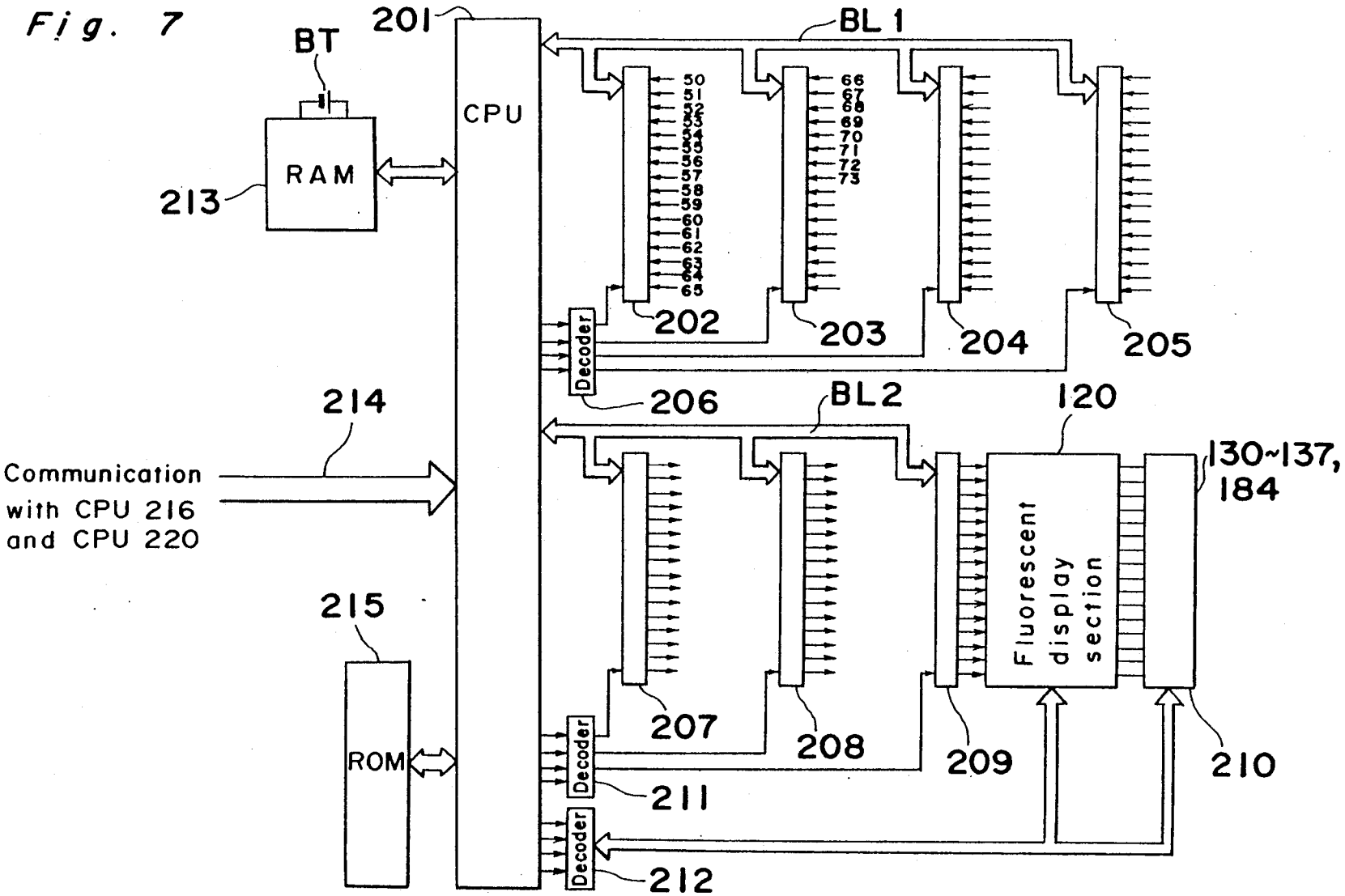
FIG. 7 is a schematic block diagram of a CPU 201 for controlling the action of the copying machine shown in FIG. 1 and periphral units thereof.

FIG. 7 shows a CPU 201 for controlling the action of the copying machine and peripheral units thereof.

Referring to FIG. 7, there are provided input port integrated circuits (the integrated circuits are referred to as ICs hereinafter) 202 to 205 for inputting data, and output port ICs 207 to 209 for outputting data. The output terminals of the input port ICs 202 to 205 are connected to the CPU 201 through a bus BL1, and the input terminals thereof are connected to the keys 50 to 73 and 84, the switches 35, and the displays etc. shown in FIG. 4. The input port ICs 202 to 205 are controlled through a decoder 206 by the CPU 201. The input terminals of the output port ICs 207 to 209 are connected to the CPU 201 through a bus BL2, and the output terminals thereof are connected to various parts shown in FIG. 4, the fluorescent display section 120, and an LED matrix display 210 comprised of the LEDs 130 to 137 and 184. The output port ICs 207 to 209 are controlled through a decoder 212 by the CPU 201.

A RAM 213 is connected to the CPU 201, and the memory storage thereof is backed up by a battery BT. A ROM 215 for storing a system control program is connected to the CPU 201. Furthermore, a bus 214 for connecting to the other CPUs 216 and 220 is connected to the CPU 201.

Figure 8:
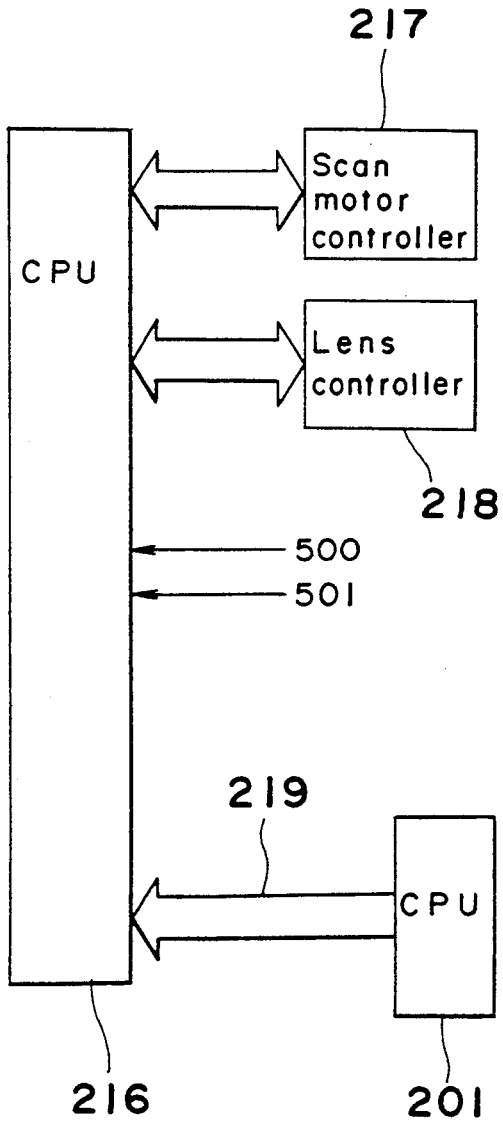
FIG. 8 is a schematic block diagram of a CPU 216 for controlling an optical system of the copying machine shown in FIG. 1 and peripheral an units thereof.

FIG. 8 shows an input and output connection of the CPU 216 for controlling the optical system 8.

Referring to FIG. 8, the input and output terminals of the CPU 216 are connected to a scan motor controller 217 for controlling the scan motor M3, and a lens controller 218 for controlling a motor (not shown) for moving the lens 15 so as to alter the magnification. A signal outputted from the predetermined position switch 500 of the optical system 8 and a timing signal for rotating a pair of timing rollers 26 in the equal magnification mode generated by a switch 501 are input to the CPU 216. Furthermore, the CPU 216 communicates with the CPU 201 through a bus 219.

Figure 9:
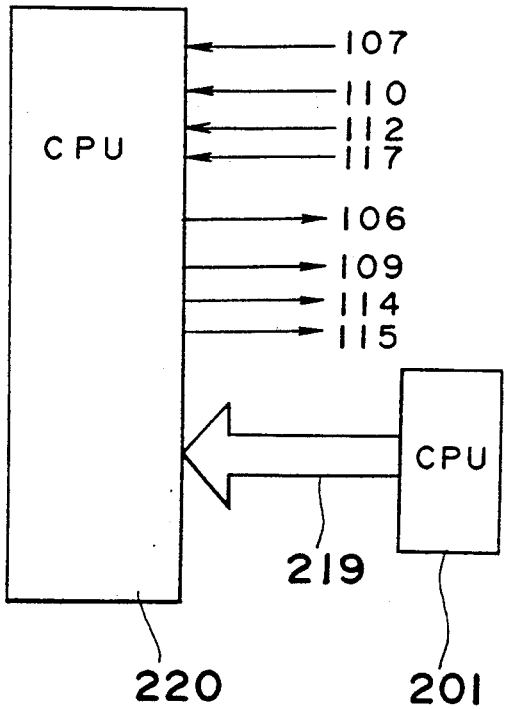
FIG. 9 is a schematic block diagram of a CPU 220 for controlling an automatic document feeder (ADF) of the copying machine shown in FIG. 1 and peripheral units thereof.

FIG. 9 shows an input and output connection of the CPU 220 for controlling the ADF 100.

Referring to FIG. 9, the CPU 220 outputs respective signals to the document feeding motor 106, the driving motor 109, the reverse motor 114 and the solenoid 115, respectively, and receives respective signals from the sensors 107, 110, 112 and 117. Furthermore, the CPU 220 communicates with the CPU 201 through the bus 219.

(e) ACTION OF COPYING MACHINE

The action of the copying machine constructed as described above will be described below with reference to flowcharts of FIGS. 10 to 20*a* and 20*b*.

(e-1) MAIN ROUTINE

Figure 10:
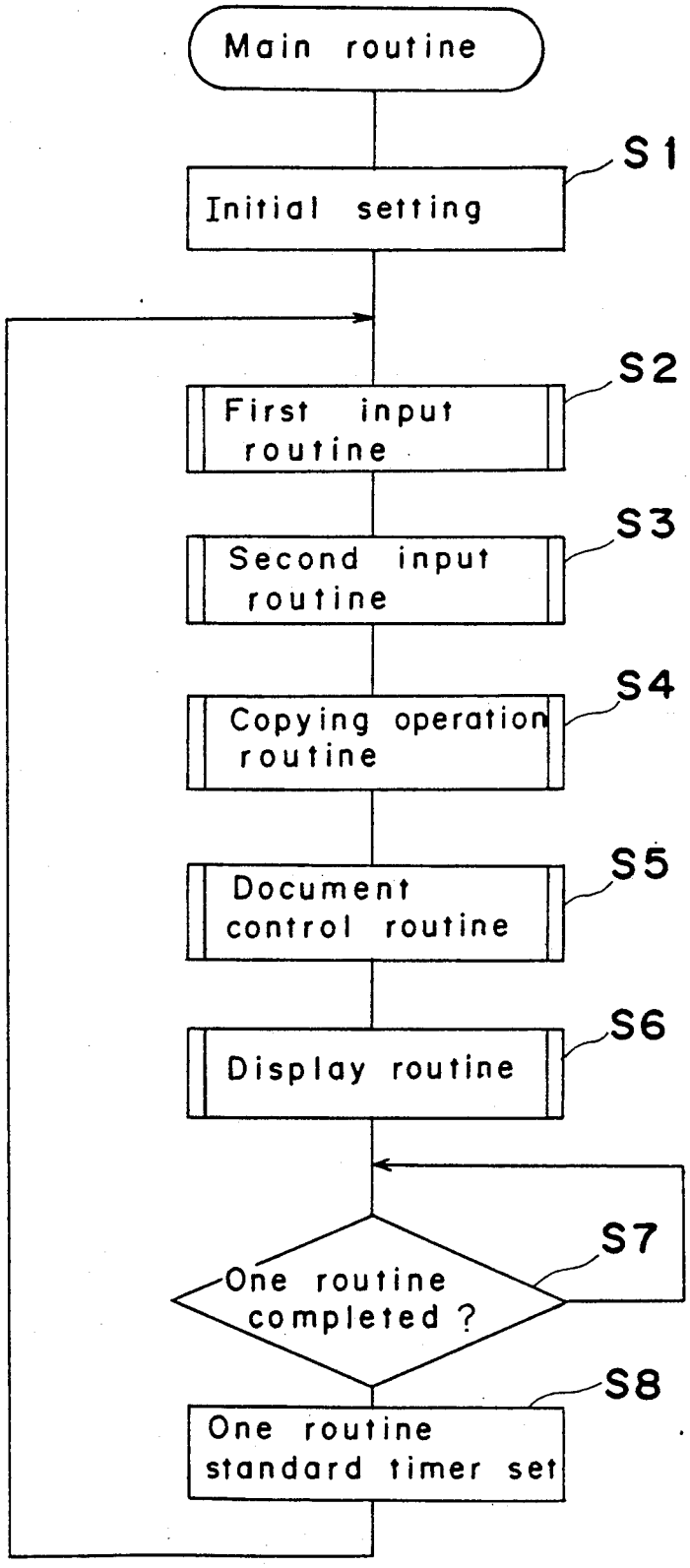
FIG. 10 is a flowchart of a main routine of the copying machine shown in FIG. 1.

FIG. 10 shows a main routine of the control operation of the copying machine.

Referring to FIG. 10, first of all, when the power of the copying machine is turned on, the data stored in the memories are initialized at step S1. There are provided a waste toner full counter for counting the number of copies until the waste toner container 33 becomes full of the waste toner, and a fixing web counter for counting the number of copies until the fixing web has been exhausted, wherein each of the waste toner full counter and the fixing web counter is incremented by one upon each copying operation. It is noted that the waste toner full counter and the fixing web counter are not cleared at this step S1.

Thereafter, the program flow goes to step S2 of a first input routine in order to input information regarding the copy conditions to be set using the keys of the first operation panel PL1 such as a number of copies etc., and a copying mode is set. At step S3 of a second input routine, information which is set using the keys of the second operation panel PL2 such as setting information of the clearing mode of the waste toner full counter and the clearing mode of the fixing web counter is input. Thereafter, at step S4 of the copying operation routine, a fundamental copying operation is performed, and also the counters are controlled. At step S5 of a document control routine, automatic feeding of the document is controlled, and also the operation for turning over the both sides document is performed. Thereafter, at step S6 of a display routine, respective counting values of the waste toner full counter and the fixing web counter are displayed, and a warning display processing is performed when the above counters finish countings.

Thereafter, it is judged whether or not one routine is completed at step S7. If the timer still continues the counting, the program flow is looped at step S7. If the timer finishes it, the timer is set at step S8, and then, the program flow goes back to step S2.

(e-2) FIRST INPUT ROUTINE

Figure 11A:
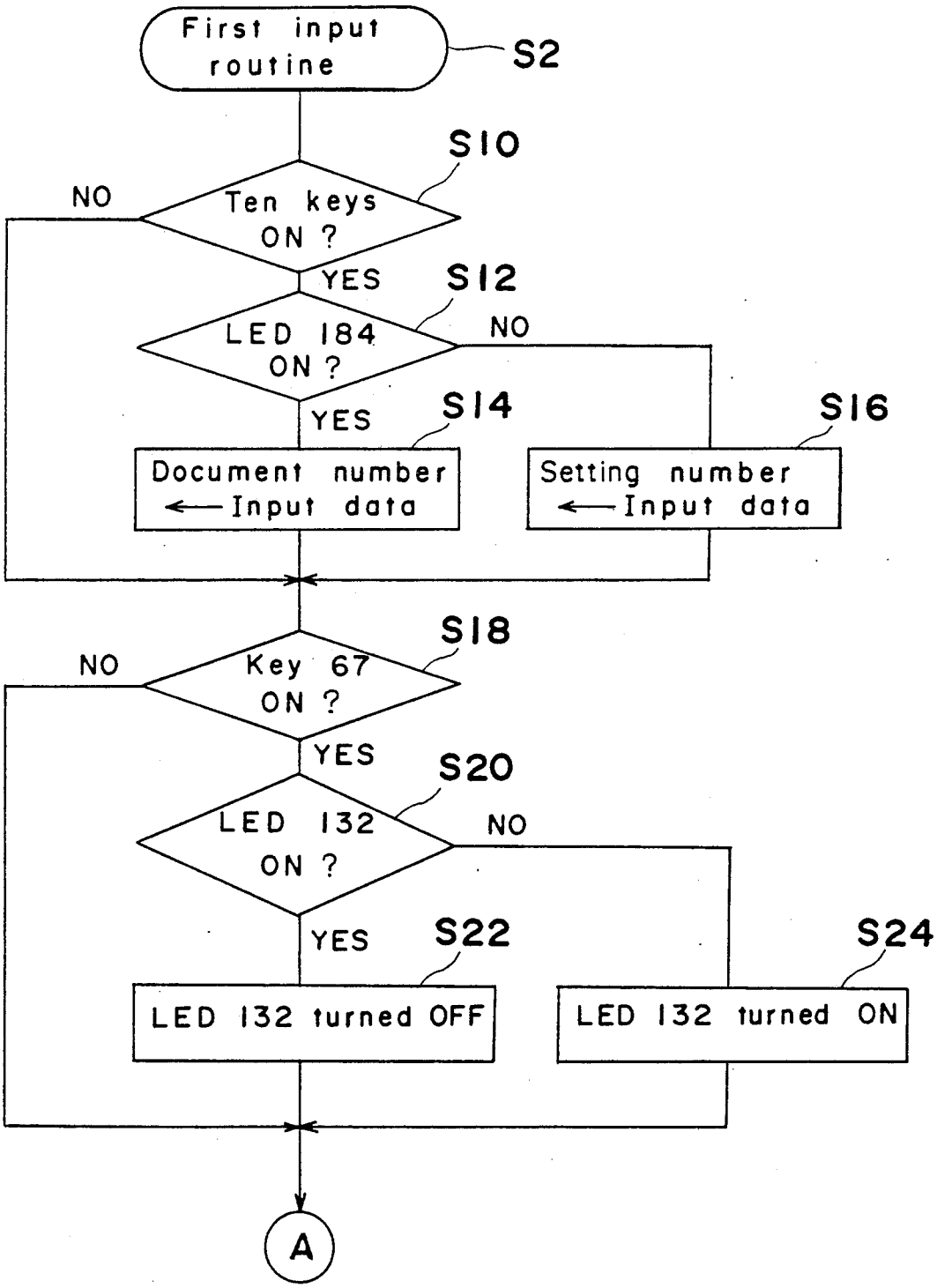
FIGS. 11*a* and 11*b* are flowcharts of a first input routine shown in FIG. 10.
Figure 11B:
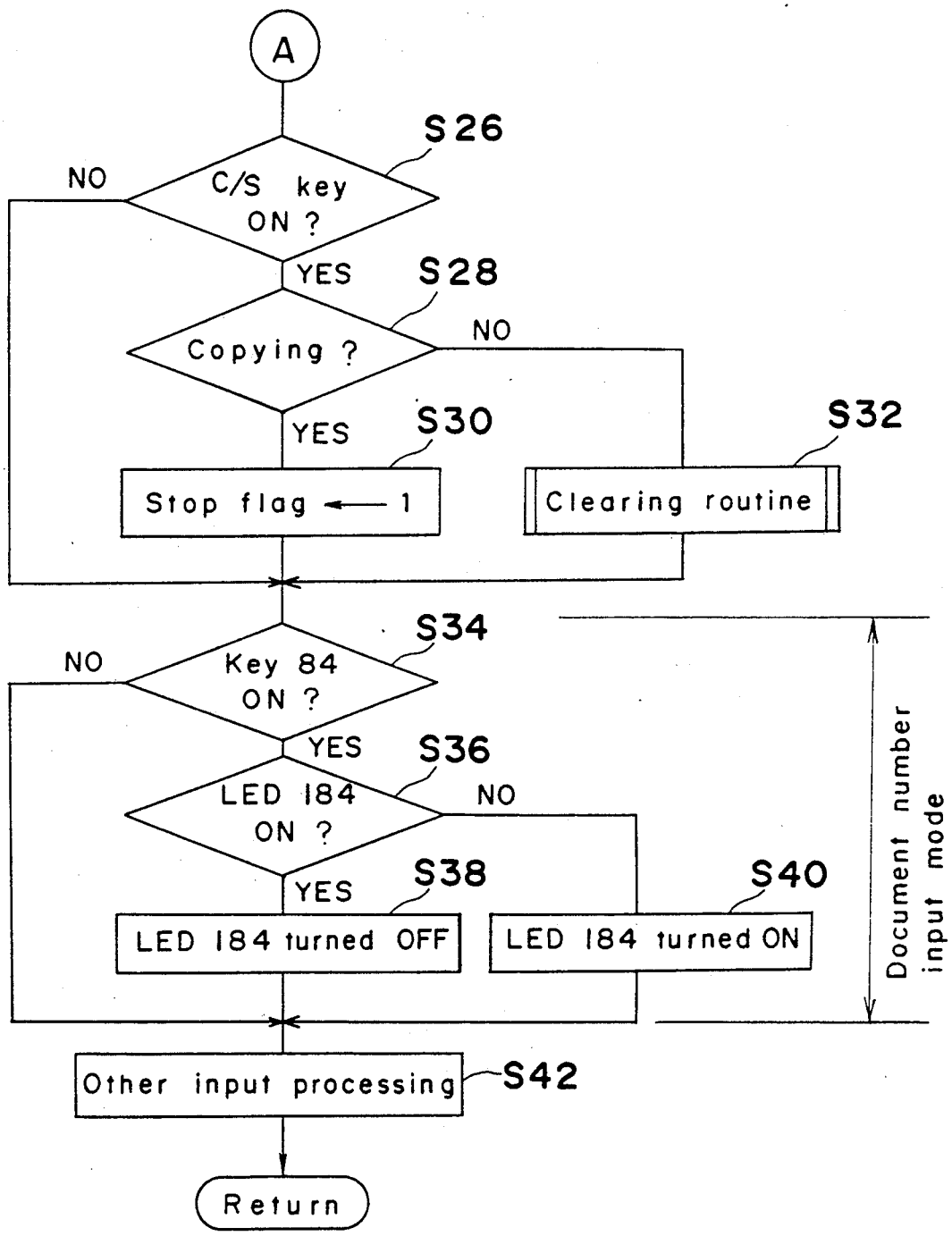

FIGS. 11*a* and 11*b* show the first input routine (step S2) shown in FIG. 10 which is an input processing for the first operation panel PL1.

Referring to FIG. 11*a*, if either ten keys 51 to 60 is turned on (Yes at step S10), it is judged whether or not the LED 184 is turned on, i.e., the document number input mode is set at step S12. If the document number input mode is set, the input value is stored as the number of documents at step S14. On the other hand, if the document number input mode is not set, the input value is stored as the number of copies at step S16. Then, the program flow goes to step S18.

Thereafter, if the both sides document key 67 is pressed (Yes at step S18), it is judged whether or not the LED 132 is turned on, i.e., the both sides document copying mode is set at step S20. If the both sides document copying mode is set (Yes at step S20), the LED 132 for displaying the both sides document copying mode is turned off at step S22, on the other hand, if the both sides document copying mode is not set (No at step S20), the LED 132 for displaying the both sides document copying mode is turned on at step S24. Then, the program flow goes to step S26.

Thereafter, in the case that the clear/stop key 62 is pressed (Yes at step S26), if the copying operation is performed (Yes at step S28), a stop flag is set at "1" so as to stop the copying operation at step S30. On the other hand, if the copying operation is not performed (No at step S28), a clearing routine is performed at step S32. Then, the program flow goes to step S34.

If the key 84 for inputting the document number is pressed (Yes at step S34), it is judged whether or not the LED 184 is turned on, i.e., the document number input mode is set at step S36. If the document number input mode is set (Yes at step S36), the LED 184 for displaying the document number input mode is turned off at step S38, on the other hand, if the document number input mode is not set (No at step S36), the LED 184 is turned on at step S40. Then, the program flow goes to step S42, and finally, the other input processings such as processing for selecting sizes of papers, processing for setting the exposure operation etc. are performed, and then, the program flow goes back to the main routine.

Figure 12A:
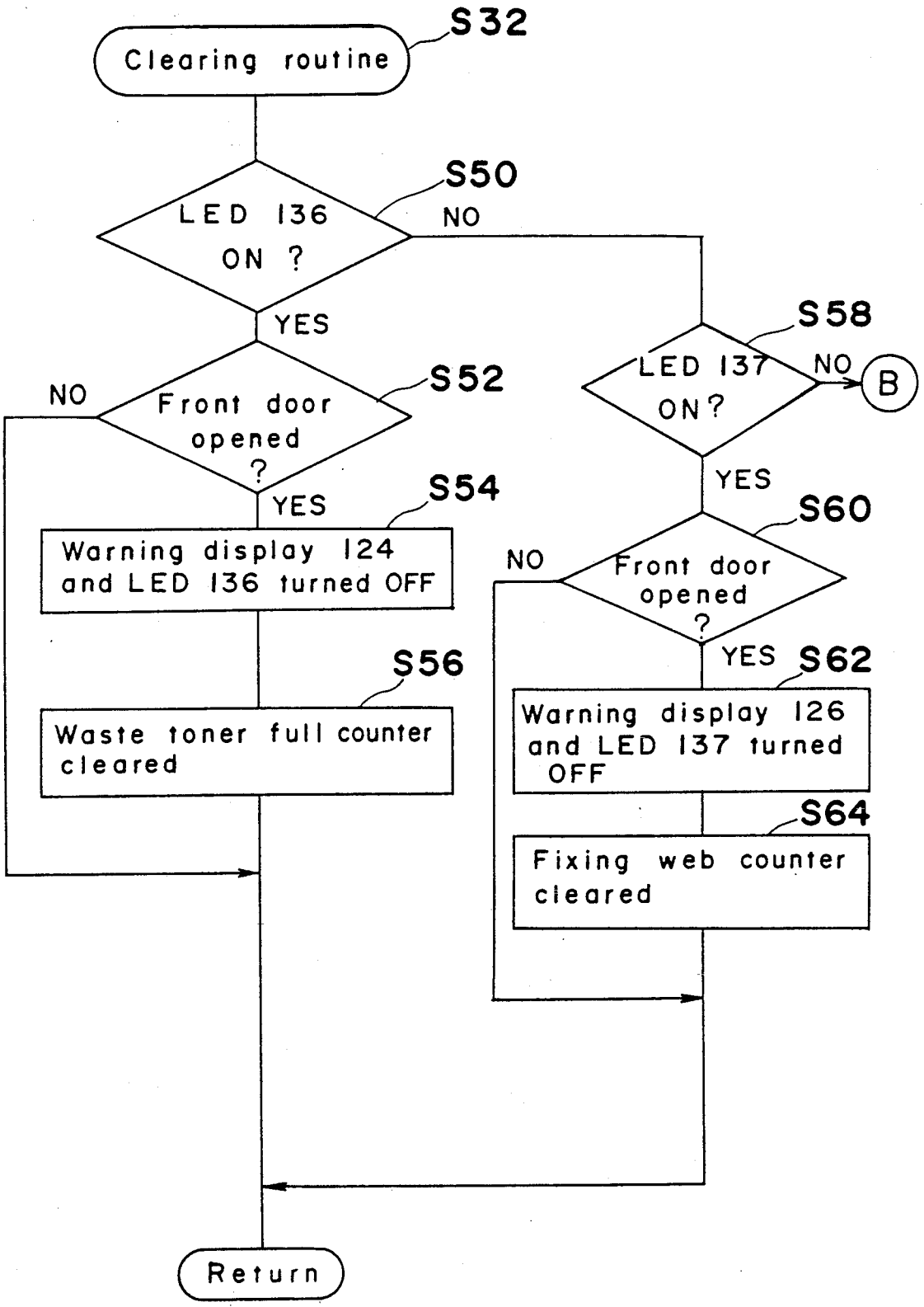
FIGS. 12*a* and 12*b* are flowcharts of a clearing routine shown in FIG. 11*a;*
Figure 12B:
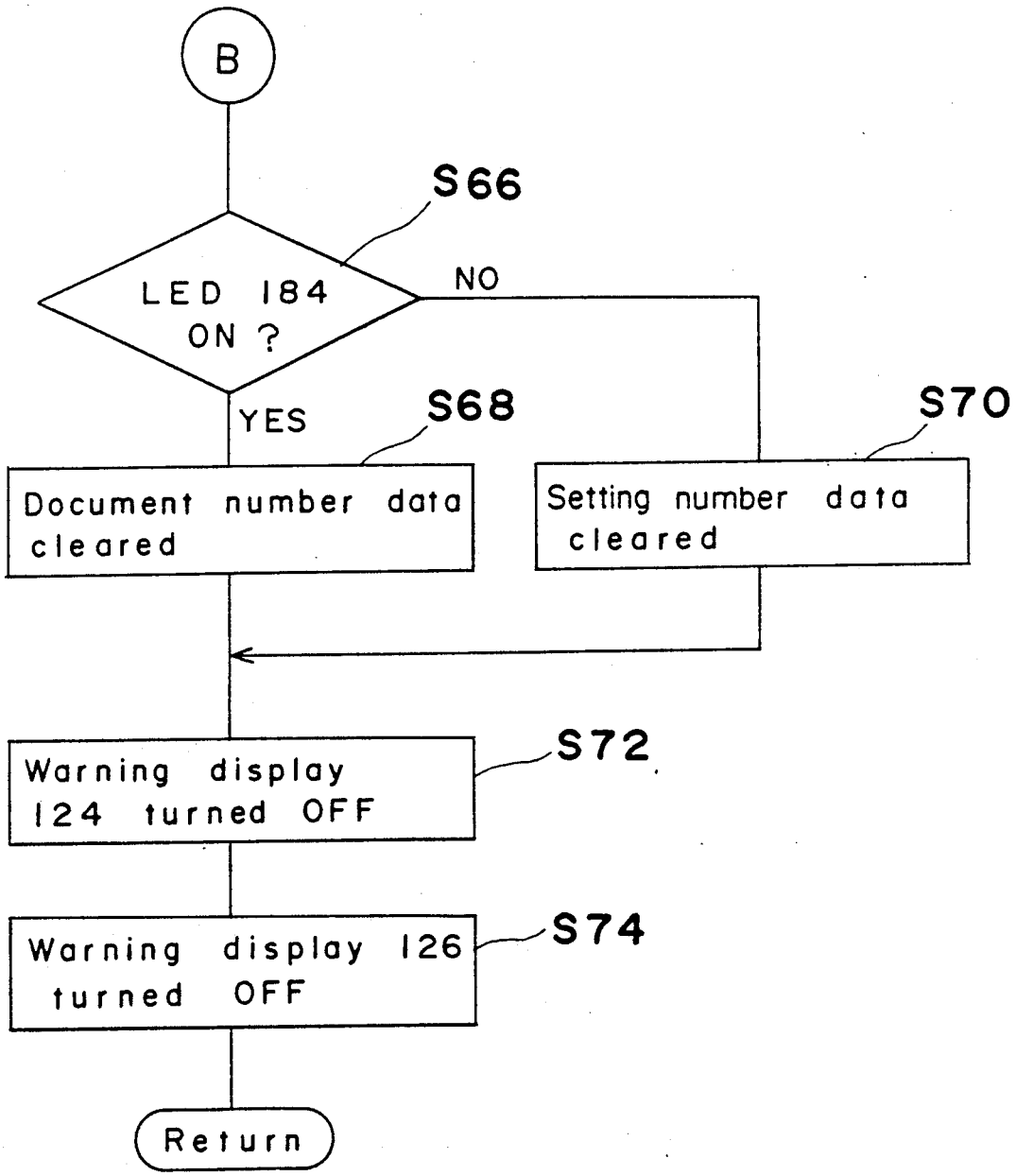

FIGS. 12*a* and 12*b* show the clearing routine (step S32) shown in FIG. 11*b*.

Referring to FIG. 12*a*, first of all, it is judged whether or not the LED 136 is turned on, i.e., the waste toner full counter clearing mode is set at step S50. If the waste toner full counter clearing mode is set (Yes at step S50) and the front door 48 of the copying machine is opened (Yes at step S52), the waste toner full display 124 for warning and the LED 136 are turned off at step S54, and the waste toner full counter is cleared at step S56, and then, the program flow returns. On the other hand, if the waste toner full counter clearing mode is set (Yes at step S50) and the front door 48 is not opened (No at step S52), the program flow returns directly.

If the waste toner full counter clearing mode is not set (No at step S50), it is judged whether or not the LED 137 is turned on, i.e., the fixing web counter clearing mode is set at step S58. If the fixing web counter clearing mode is set (Yes at step S58) and the front door 48 of the copying machine is opened (Yes at step S60), the fixing web empty display 126 and the LED 137 is turned off at step S62, and the fixing web counter is cleared at step S64, and then, the program flow returns. On the other hand, if the fixing web counter clearing mode is set (Yes at step S58) and the front door 48 is completely closed (No at step S60), the program flow returns directly.

If the fixing web counter clearing mode is not set (No at step S58), it is judged whether or not the LED 184 is turned on, i.e., the document number input mode is set at step S66. If the document number input mode is set (Yes at step S66), the document number data stored in the memory is cleared at step S68, and then, the program flow goes to step S72. On the other hand, if the document number input mode is not set (No at step S66), the copy number data stored in the memory is cleared at step S70, and then, the program flow goes to step S72.

Thereafter, the waste toner full display 124 and the web empty display 126 are turned off at steps S72 and S74, respectively, and then, the program flow returns.

(e-3) SECOND INPUT ROUTINE

Figure 13:
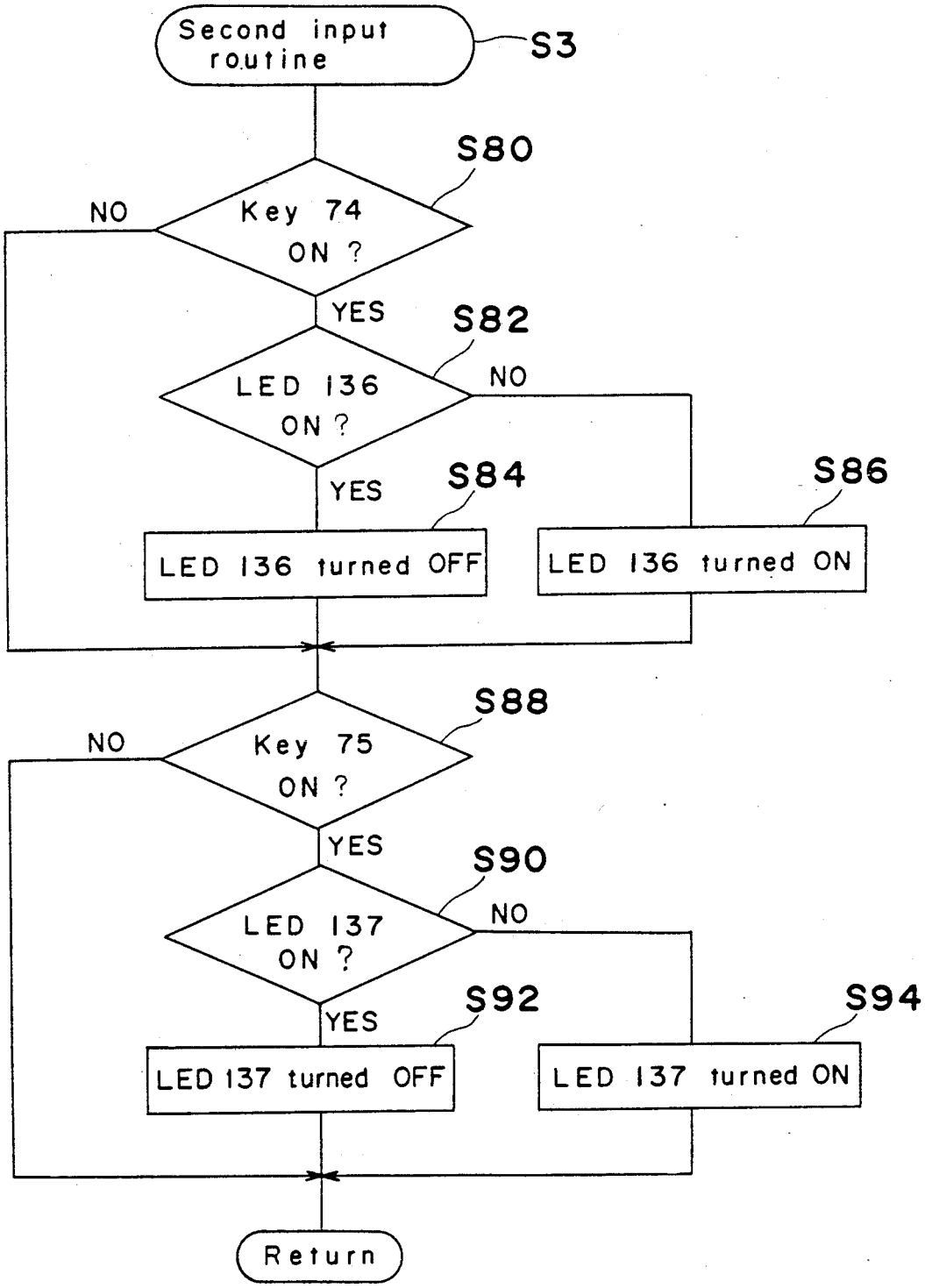
FIG. 13 is a flowchart of a second input routine shown in FIG. 10.

FIG. 13 shows the second input routine (step S3) shown in FIG. 10, which is an input processing for the second operation panel PL2 arranged inside of the front door 48 of the copying machine.

Referring to FIG. 13, if the key 74 (shown in FIG. 6) for clearing the waste toner full counter is pressed (Yes at step S80), it is judged whether or not the LED 136 is turned on, i.e., the waste toner full counter clearing mode is set at step S82. If the waste toner full counter clearing mode is set (Yes at step S82), the LED 136 is turned off so as to cancel the waste toner full counter clearing mode at step S84. On the other hand, if the waste toner full counter clearing mode is not set (No at step S82), the LED 136 is turned on at step S86. Then, the program flow goes to step S88.

If the key 75 for clearing the fixing web counter is pressed, it is judged whether or not the LED 137 is turned on, i.e., the fixing web counter clearing mode is set at step S90. If the fixing web counter clearing mode is set (Yes at step S90), the LED 137 is turned off so as to cancel the fixing web counter clearing mode at step S92. On the other hand, if the fixing web counter clearing mode is not set (No at step S90), the LED 137 is turned on so as to clear the fixing web counter at step S94. Then, the program flow returns.

(e-4) COPYING OPERATION

FIGS. 14*a* to 14*f* show the copying operation routine (step S4) shown in FIG. 10.

First of all, it is judged whether or not the print key 50 is pressed at step S131. If the print key 50 is pressed (Yes at step S130) and the both sides copying mode is set (Yes at step S1310), twice the product of the setting number and the document number is calculated so as to set the calculated value as a copy number data C in a calculation "A" processing of step S1312. On the other hand, if the print key 50 is pressed (Yes at step S130) and the both sides copying mode is not set (No at step S1310), the product of the setting number and the document number is calculated so as to set the calculated value as the copy number data C in a calculation "B" processing of step S1314. Then, the program flow goes to step S1316.

At step S1316, in order to know the number of copies which can be obtained hereafter using the fixing web in use on the basis of the counting value of the fixing web counter, the difference between the number of copies predetermined at the initial setting processing and the counting value of the fixing web counter is calculated and it is set as a remainder value W of the fixing web counter in order to compare the copy number data C calculated at step S1312 or S1314 with the above remainder value W. If the copy number data C is larger than the remainder value W (Yes at step S1316), the web empty display 126 is turned on at step S1320 so as to warn that the cleaning web 43 might be exhausted before the copying operation has been completed, and the program flow goes to step S141 without setting the copy start flag so as to prohibit the copying operation.

If the copy number data C is equal to or smaller than the remainder value W (No at step S1316), the program flow goes to step S1318.

At step S1318, in order to know the number of copies which can be obtained using the toner presently set on the basis of the counting value of the waste toner full counter, a difference between the number of copies predetermined at the initial setting processing and the counting value of the waste toner full counter is calculated and it is set as a remainder value T of the waste toner full counter in order to compare copy number data C calculated at step S1312 or S1314 with the above remainder value T. If the copy number data C is larger than the remainder value T (Yes at step S1318), the waste toner full display 124 is turned on at step S1322 in order to warn that the waste toner container 33 will become full of the waste toner before the copying operation has been completed, and the program flow goes to step S141 without setting the copy start flag in order to prohibit the copying operation.

Thus, since it is detected and warned previously that the copying operation is prohibited, the operator can perform a necessary processing before starting the copying operation and the copying operation can be prevented from being stopped during the copying operation, and also the working efficiency in the copying operation can be prevented from decreasing. Furthermore, the above advantages can be also obtained upon copying the both sided documents.

Figure 14A:
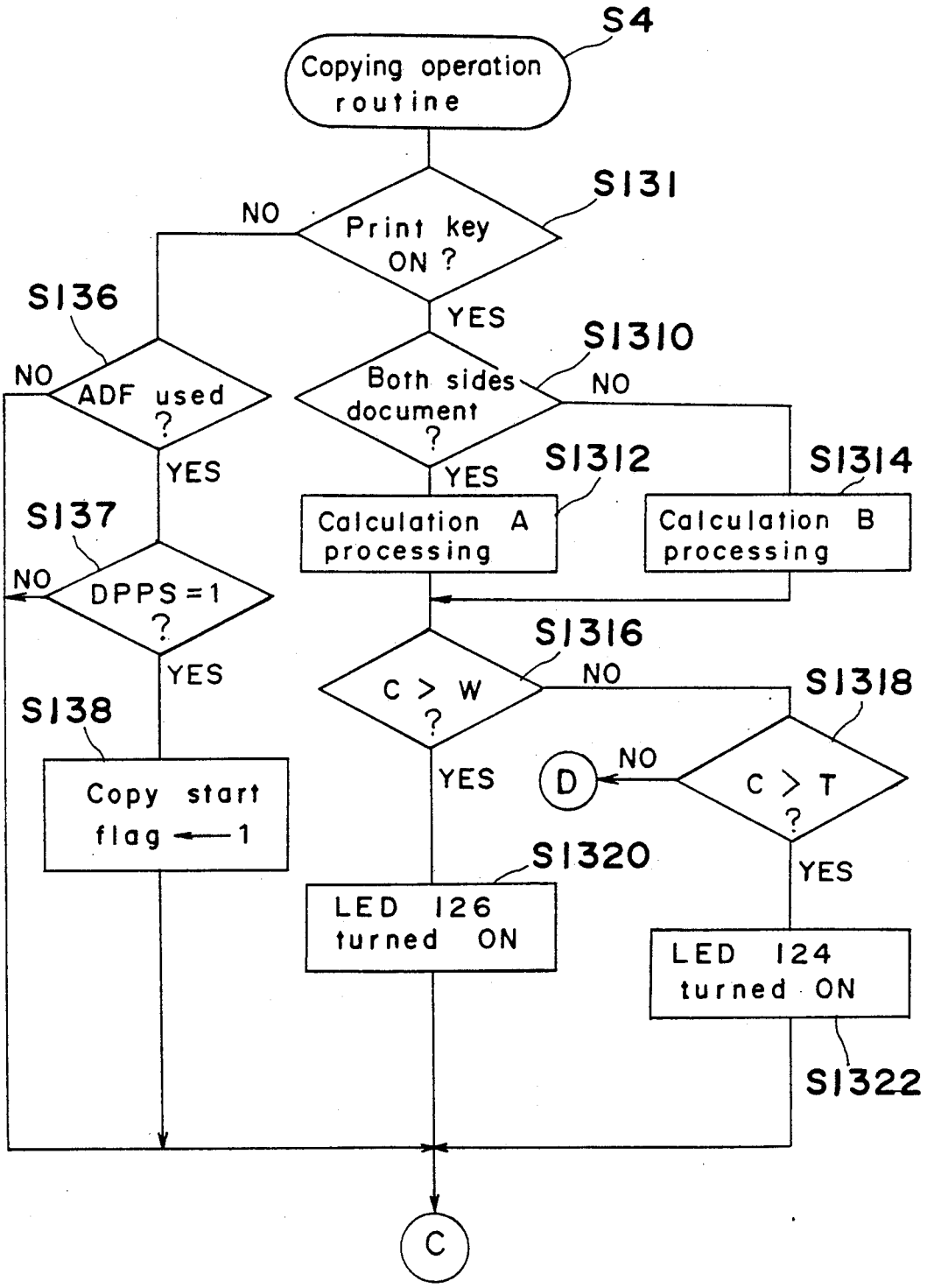
FIGS. 14*a* to 14*f* are flowcharts of a copying control routine shown in FIG. 10.
Figure 14B:
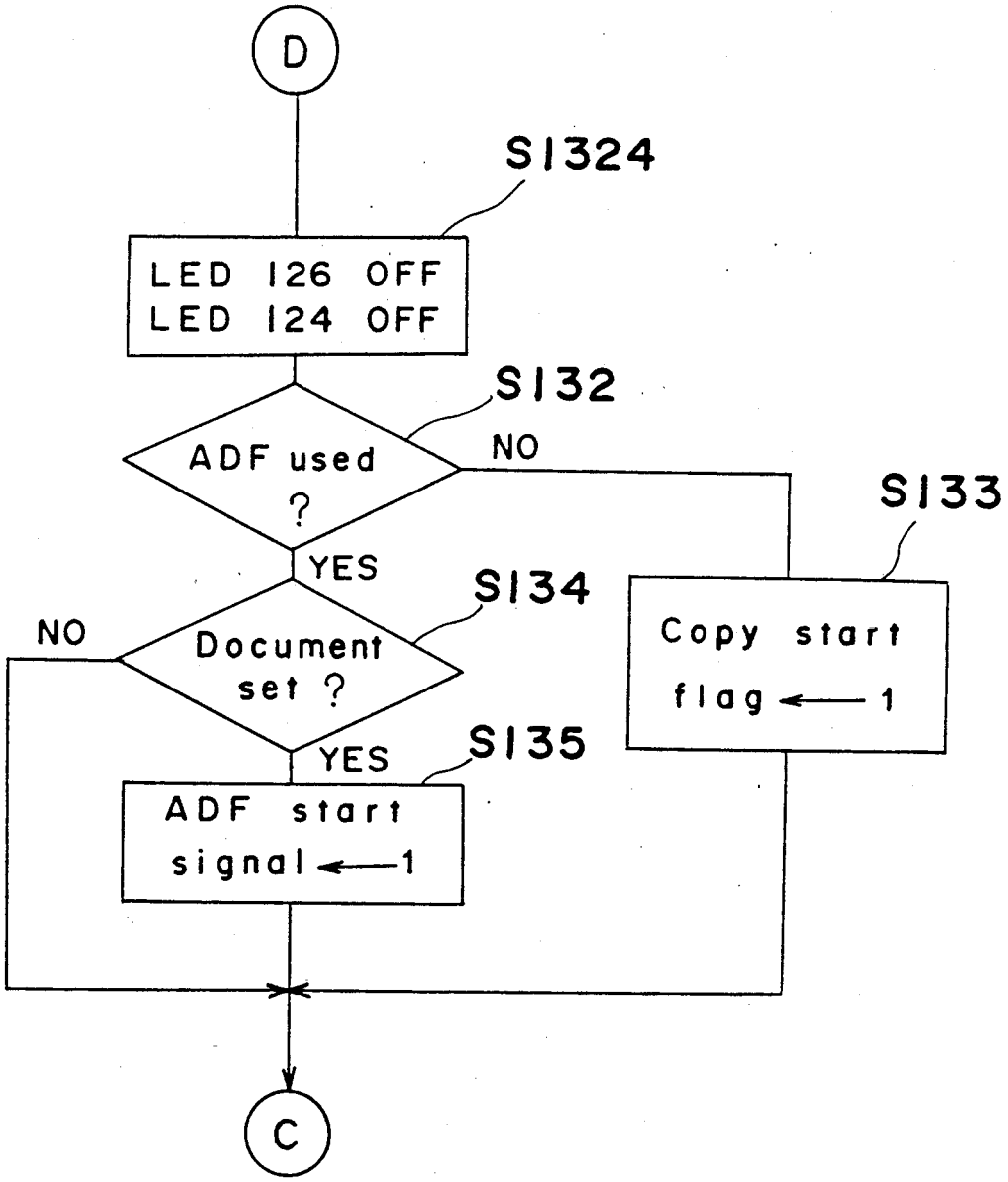

If the copy number data C is equal to or smaller than the above-calculated remainder value T (No at step S1318), as shown in FIG. 14*b*, the waste toner full display 124 and the web empty display 126 are turned off, and then, the program flow goes to step S132. At step S132, it is judged whether or not the ADF 100 is used. If the ADF 100 is not used (No at step S132), the copy start flag is set at "1" at step S133, and then, the program flow goes to step S141. On the other hand, if the ADF 100 is used (Yes at step S132), it is judged whether or not the document is set on the document tray 104 at step S134. If the document is set on the document tray (Yes at step S134), an ADF start signal is set at "1" and is outputted to the ADF 100, and then, the program flow goes to step S141. On the other hand, if the document is not set on the document tray (No at step S134), the program flow goes to step S141 directly.

Referring back to FIG. 14*a*, if the print key 50 is not pressed (No at step S131), it is judged whether or not the ADF 100 is used at step S136, and it is judged whether or not a document predetermined position signal DPPS outputted from the ADF 100 is "1", namely, the document is set at a predetermined position of the ADF 100 at step S137. If the ADF 100 is used (Yes at step S136) and the document predetermined position signal DPPS is "1" (Yes at step S137), the copy start flag is set at "1" at step S138, and then, the program flow goes to step S141. On the other hand, if the ADF 100 is not used (No at step S136) or the document predetermined position signal DPPS is not "1" (No at step S137), the program flow goes to step S141 directly.

Thereafter, the copying operation is performed as follows.

Figure 14C:
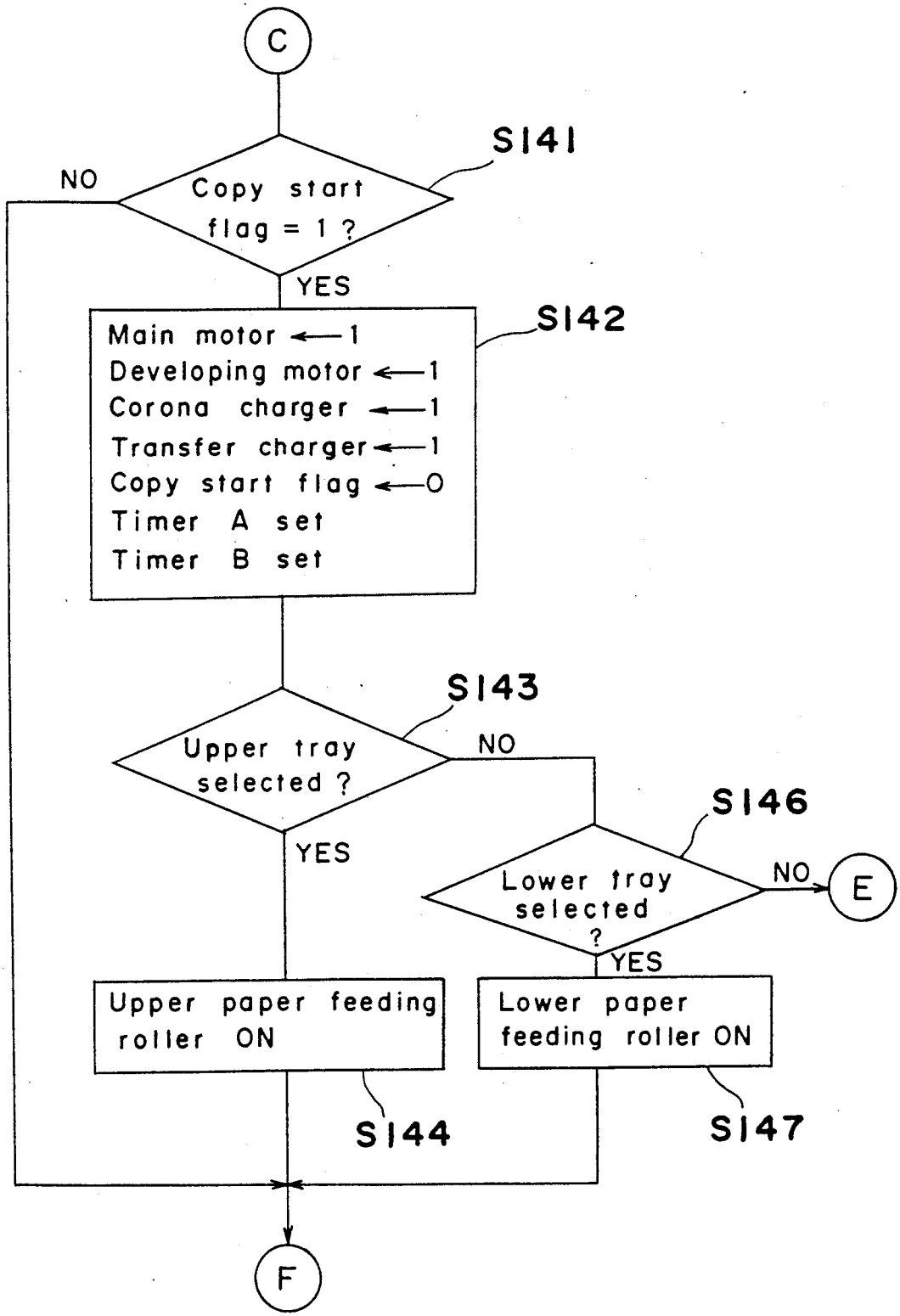
Figure 14D:
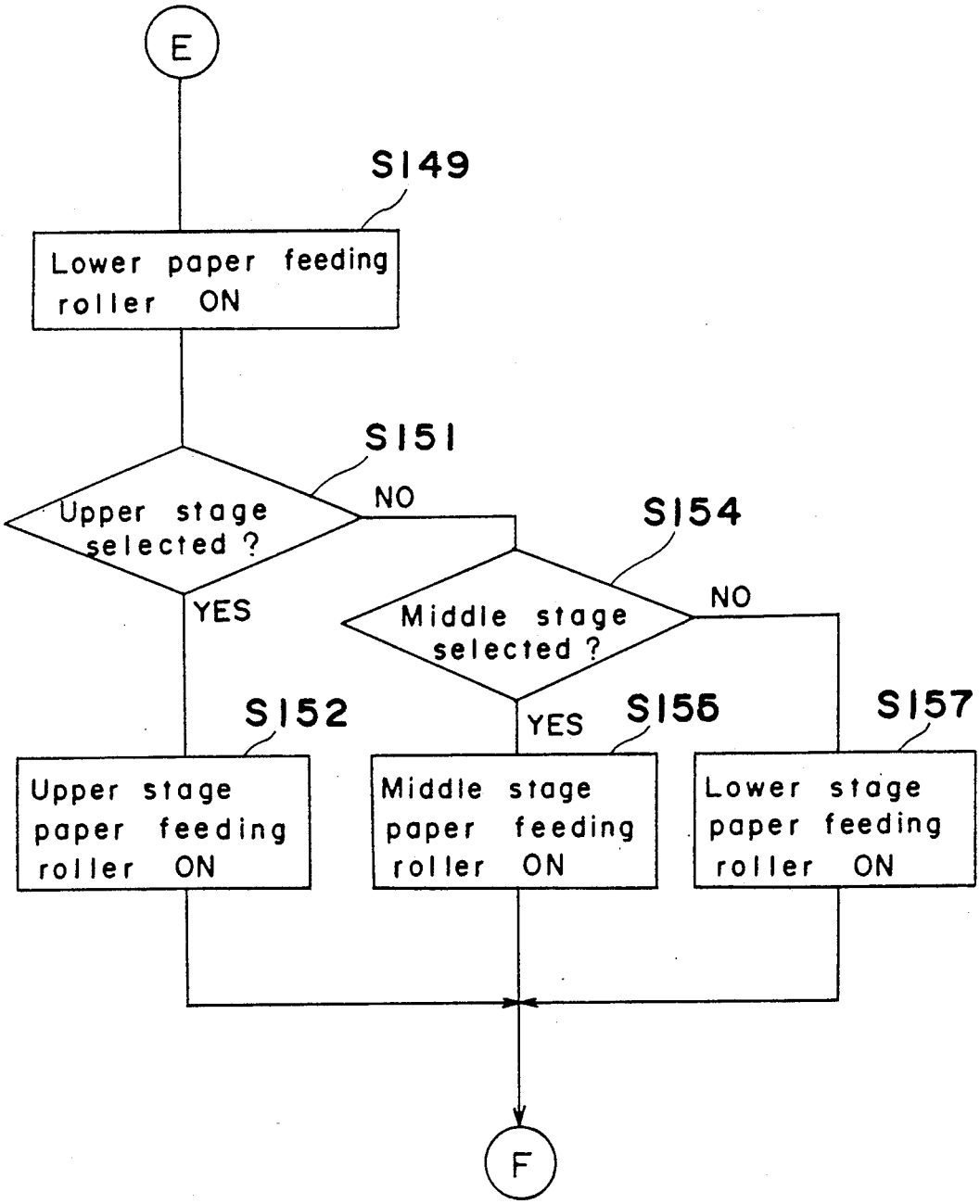
Figure 14E:
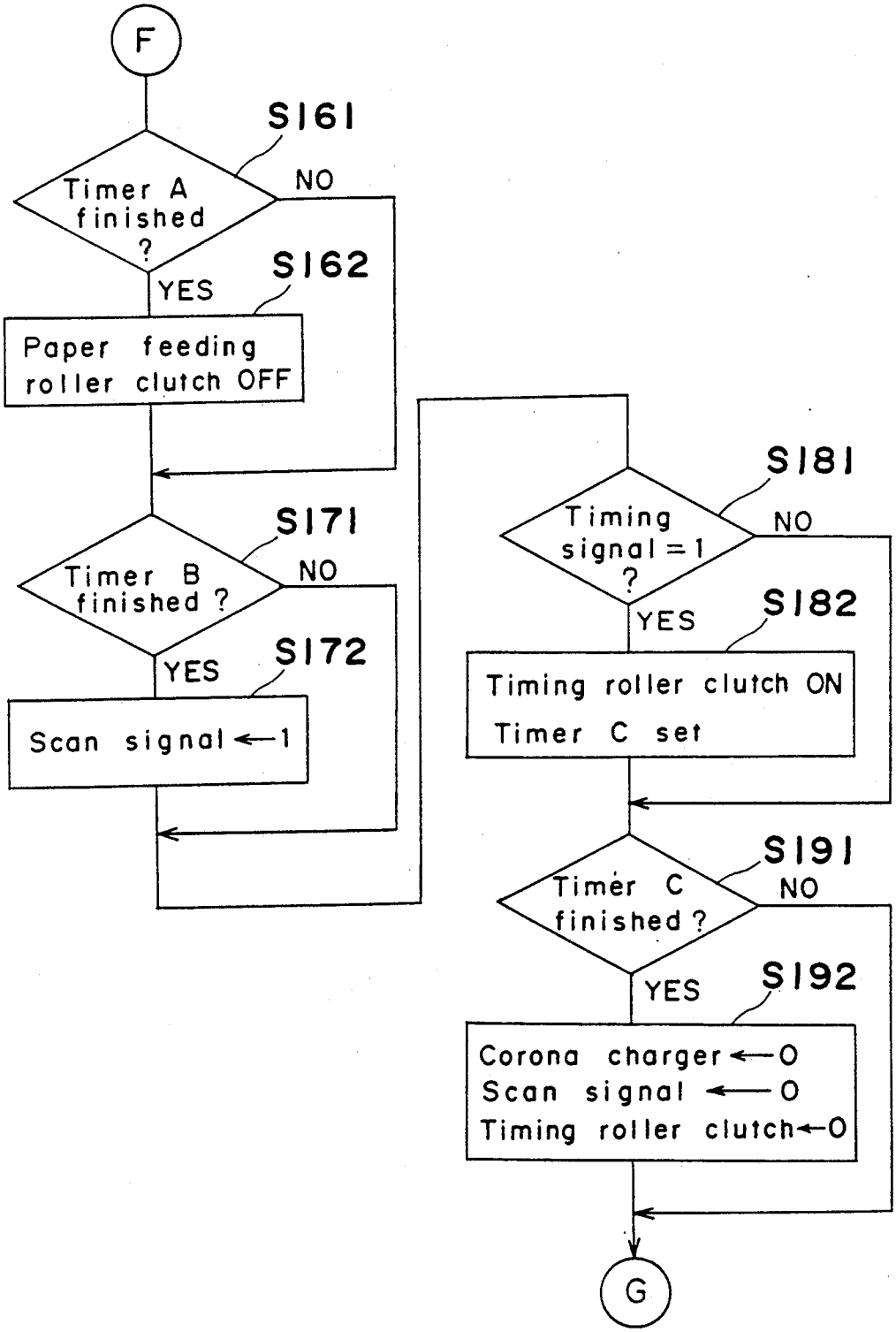
Figure 14F:
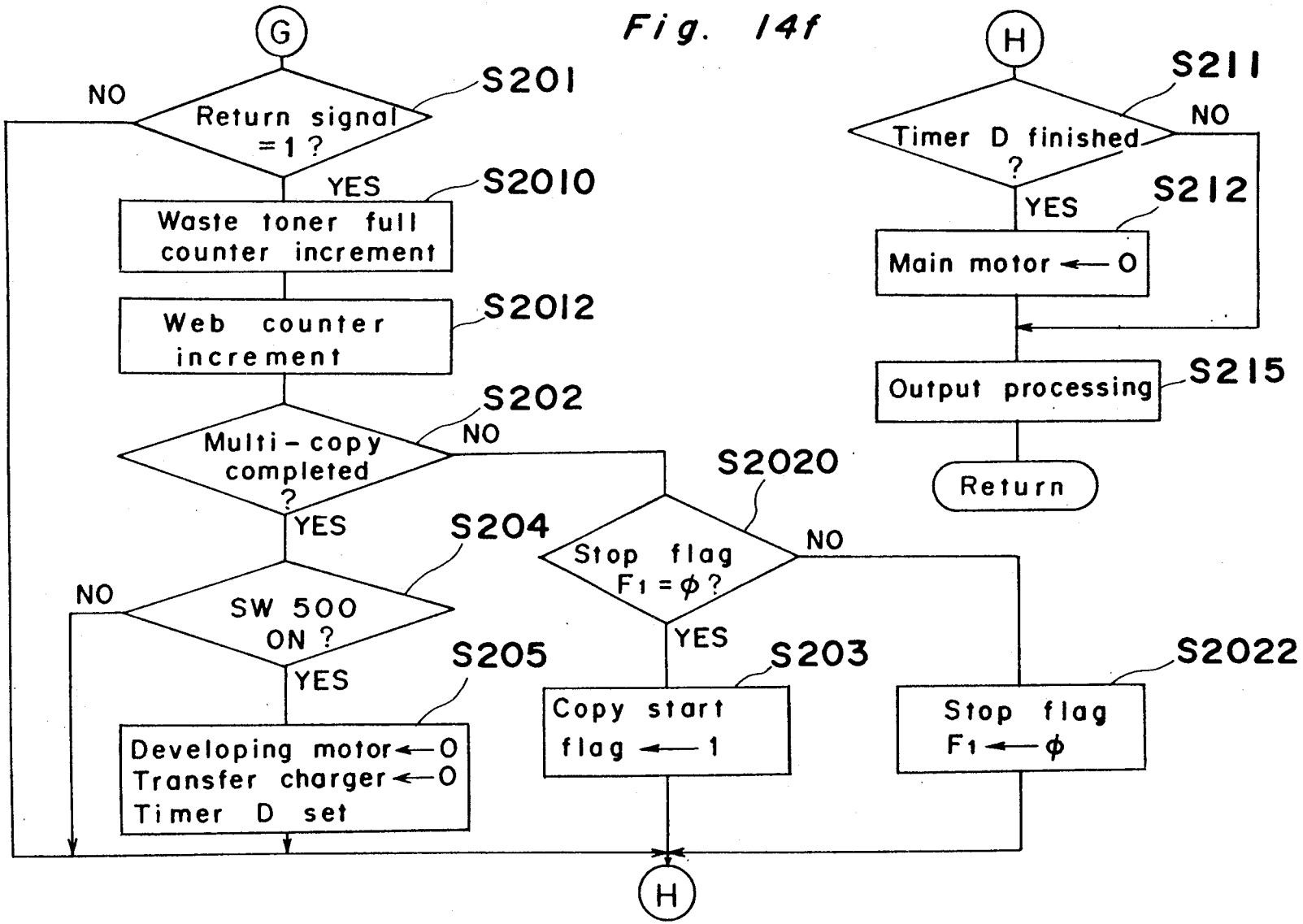

Referring to FIG. 14*c*, if the copy start flag is "1" (Yes at step S141), the main motor, the developing motor, the corona charger 3 and the transfer charger 5 etc. are turned on, the copy start flag is set at "0", and both the timers A and B are set at step S142, and then, a paper feeding roller of the selected paper feeding tray is driven as follows. On the other hand, if the copy start flag is not "1" (No at step S141), the program flow goes to step S161.

If the upper paper feeding tray 23 shown in FIG. 1 is selected (Yes at step S143), the upper paper feeding roller 21 is driven at step S144. On the other hand, if the lower paper feeding tray 22 is selected (Yes at step S146), the lower paper feeding roller 22 is driven at step S147. Then, the program flow goes to step S161.

Furthermore, when an optional three-stage paper feeding unit (not shown) is used in place of the lower paper feeding tray 24, the paper feeding roller 22 is driven at step S149, and then, the program flow goes to step S151. If an upper tray of the three-stage paper feeding unit is selected (Yes at step S151), an upper paper feeding roller of the three-stage paper feeding unit is driven at step S152. If a middle tray thereof is selected (Yes at step S154), a middle paper feeding roller thereof is driven at step S155. If a lower tray thereof is selected, and a lower paper feeding roller thereof is driven at step S157. Thereafter, the program flow goes to step S161.

If the timer A finishes the counting thereof (Yes at step S161), the driven paper feeding roller clutch (not shown) is turned off at step S162. If the timer B finishes the counting thereof (Yes at step S163), the scan signal is set at "1" at step S172.

Thereafter, if the timing signal is "1" (Yes at step S181), a timing roller clutch (not shown) is turned on, and also the timer C is set at step S182. If the timer C finishes the counting thereof (Yes at step S191), the corona charger 3 and the timing roller clutch are turned off and also the scan signal is set at "0" at step S192, and then, the program flow goes to step S201. If a return signal of the optical system 8 is "1", i.e., the scanner of the optical system 8 starts to return (Yes at step S201), the counting value of both the waste toner full counter and the fixing web counter are increased by one, respectively, at step S2010 and S2012, and then, it is judged whether or not the multi-copying operation for obtaining the number of copies designated has been completed at the step S202. If the above copying operation has not been completed (No at step S202) and the stop flag is "0" i.e., the copying operation is not stopped (Yes at step S2020), the copy start flag is set at "1" at step S203, and then, the program flow goes to step S211. On the other hand, if the above copying operation has not been completed (No at step S202) and the stop flag is not "0" (No at step S2020), the stop flag is reset at step S2022, and then, the program flow goes to step S211.

Furthermore, if the above copying operation has been completed (Yes at step S202), it is judged whether or not the scanner of the optical system 8 has been returned to the aforementioned home position and the predetermined position switch 500 has been turned on at step S204. If the switch 500 is turned on (Yes at step S204), the developing motor and the transfer charger 5 are turned off and also the timer D is set at step S205, and then, the program flow goes to step S211. On the other hand, if the switch 500 is not turned off (No at step S204), the program flow goes to S211 directly.

If the timer D finishes the counting thereof (Yes at step S211), the main motor is turned off at step S212, and then, the program flow goes to step S215. If the timer D does not finish the counting thereof (No at step S211), the program flow goes to step S215 directly. Thereafter, the result of the above processing is outputted at step S215, and then, the program flow returns.

(f) DOCUMENT CONTROL ROUTINE

Figure 15A:
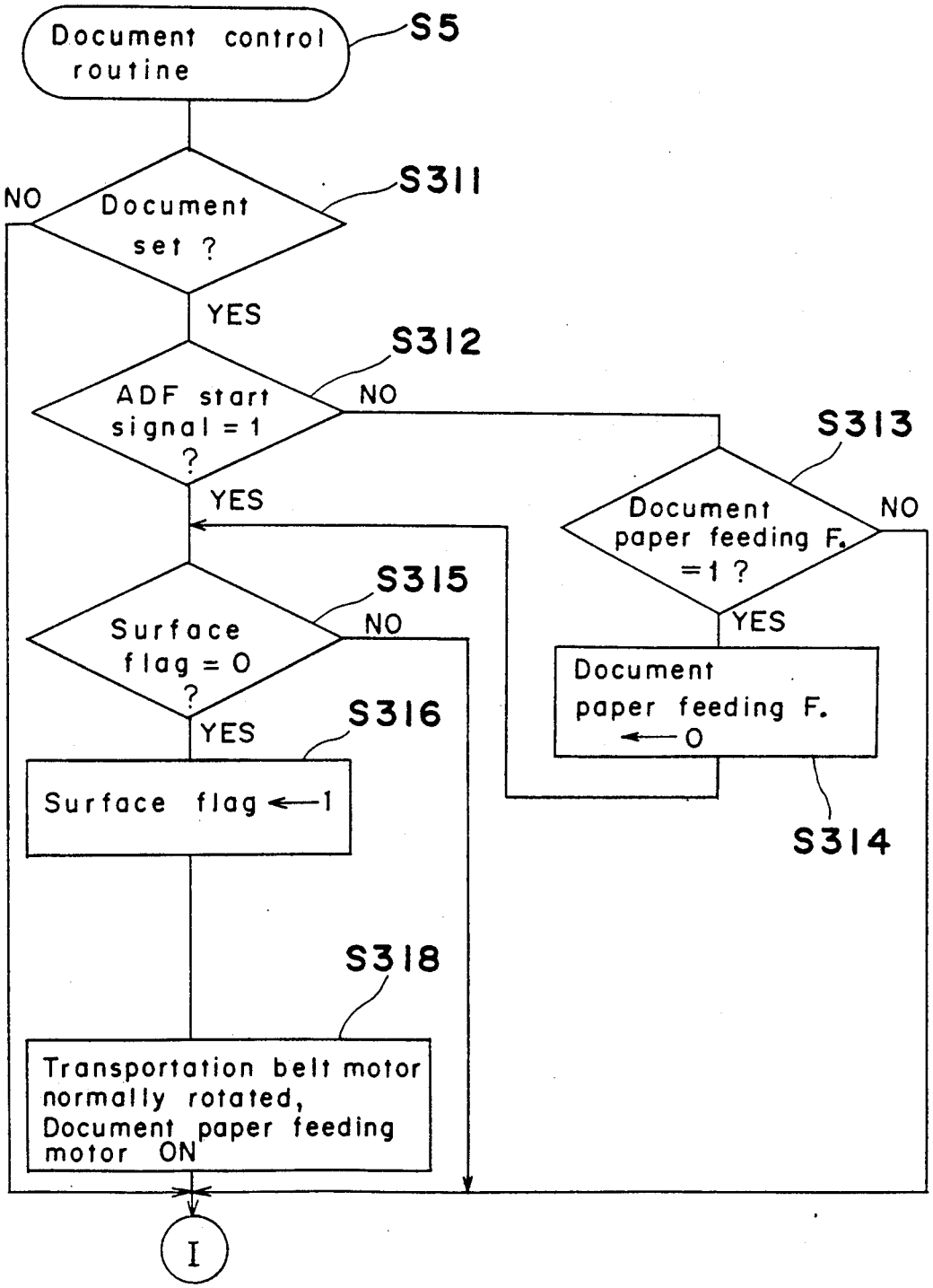

FIGS. 15*a* and 15*b* show the document control routine (step S5) shown in FIG. 10.

Referring to FIG. 15*a*, first of all, it is judged whether or not the document is set on the document tray 104, i.e., the sensor 107 for detecting the document is turned on at step S311. If the document is set on the document tray 104 (Yes at step S311), it is judged whether or not the ADP start signal outputted from the CPU 201 is "1" at step S312. If the ADF start signal is "1" (Yes at step S312), the program flow goes to step S315. On the other hand, if the ADF start signal is not "1" (No at step S312), it is judged whether or not the document paper feeding flag is "1" at step S313. If the document paper feeding flag is "1" (Yes at step S313), the document paper feeding flag is set at "0", and then, the program flow goes to step S315. On the other hand, if the document paper feeding flag is not "1" (No at step S313), the program flow goes to step S321. It is to be noted that, if the document is not set on the document tray (No at step S311), the program flow goes to step S321.

If a surface flag is "0" (Yes at step S315), the surface flag is set at "1", the motor 109 for driving the document transportation belt 108 is rotated in a normal direction and the document feeding motor 106 is turned on at step S318, and then, the program flow goes to step S321.

Referring to FIG. 15*b*, it is judged whether or not the both sides document signal is "0" at step S321. If the both sides document signal is "0" (Yes at step S321), a document feeding processing routine is performed at step S322. On the other hand, if the both sides document signal is not "0" (No at step S321), a document reverse processing routine is performed at step S323. Then, it is judged whether or not the set number of documents have been completely scanned at step S324. If the set number of documents have been completely scanned (Yes at step S324), the scan end flag is set at "1" at step S325, and then, the program flow goes to step S331. On the other hand, if the documents have not been completely scanned (No at step S324), the program flow goes to step S331.

If the scan end flag is "1" (Yes at step S331), the program flow goes to step S332, on the other hand, if the scan end flag is not "1" (No at step S331), the program flow returns directly. If the both sides document signal is "0" (Yes at step S332), or if the both sides document signal is not "0" (No at step S332) and the surface flag is not "1" (No at step S333), both the surface flag and the scan end flag are set at "0" at step S334, a document discharging processing routine is performed at step S335, and then, the program flow returns. On the other hand, if the both sides document signal is not "0" (No at step S332) and the surface flag is "1" (Yes at step S333), a document reverse processing routine is performed at step S336, and then, the program flow returns.

Figure 16:
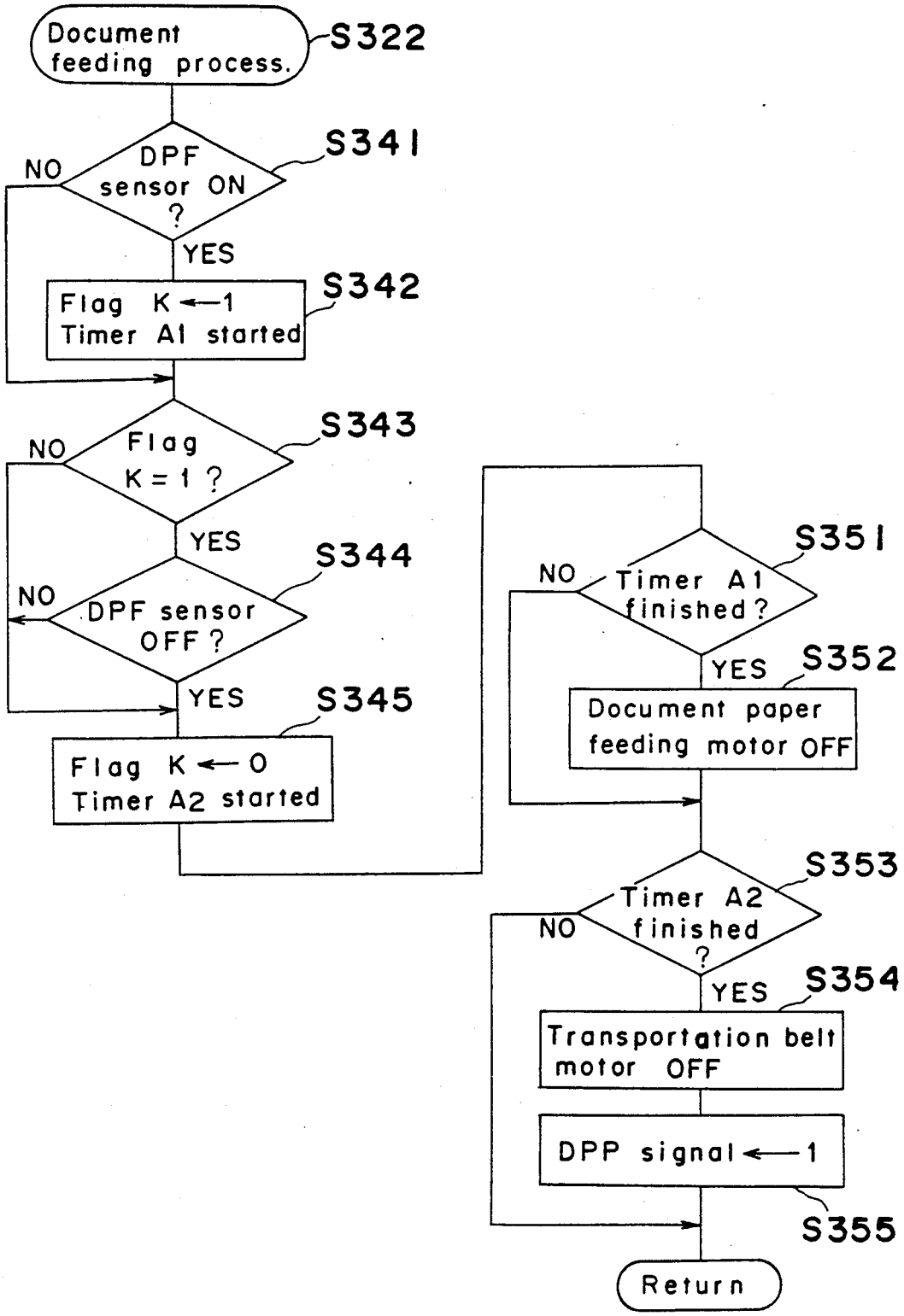
FIG. 16 is a flowchart of a document feeding processing routine shown in FIG. 15*b;*

FIG. 16 shows the document feeding processing routine (step S322) shown in FIG. 15*b*, wherein the document fed from the document tray 104 is set on the document table glass 9.

Figure 17A:
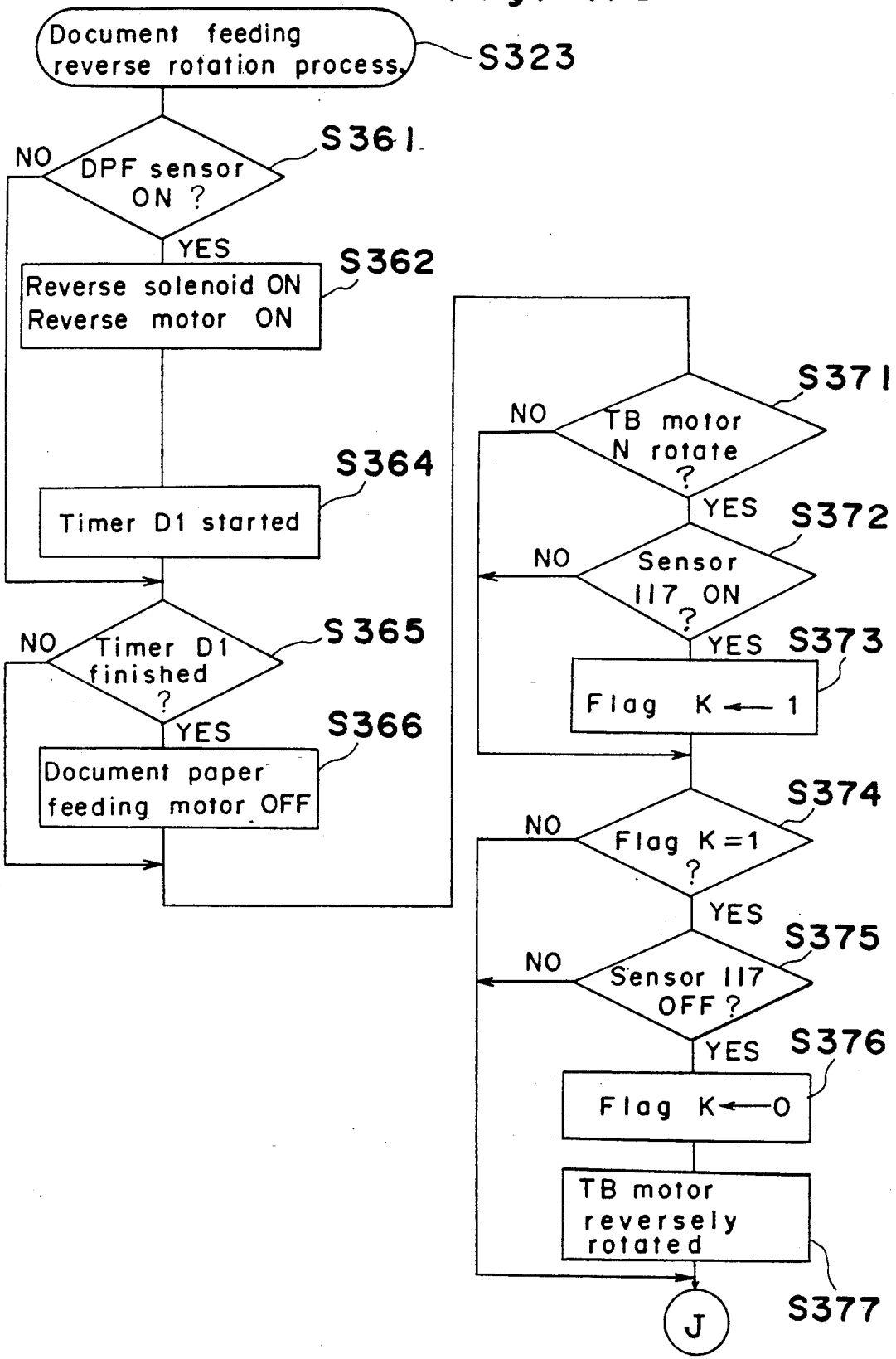
FIGS. 17*a* and 17*b* are flowcharts of a document feeding reverse rotation processing routine shown in FIG. 15*b;*
Figure 17B:
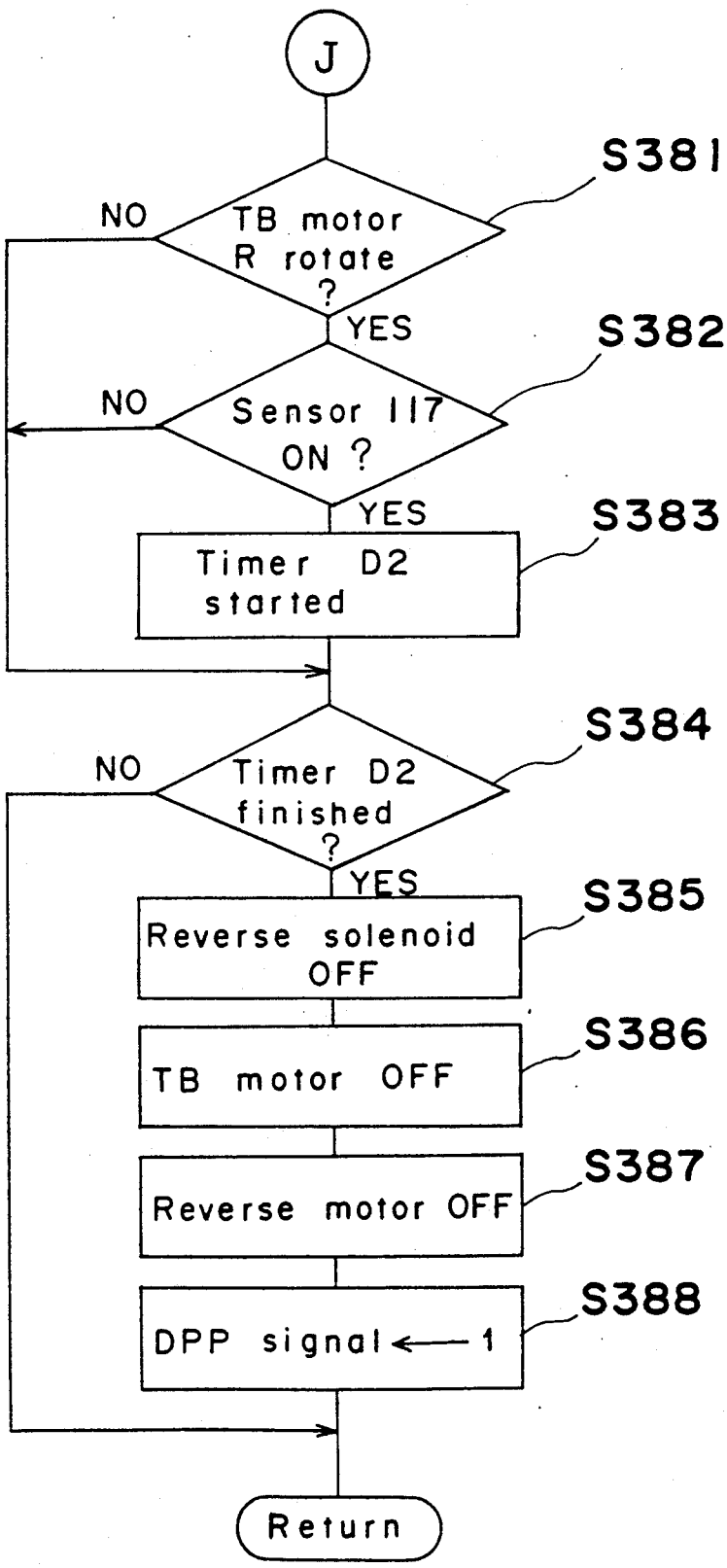

FIGS. 17*a* and 17*b* show the document feeding reverse processing routine (step S323) shown in FIG. 15*b*, wherein the document fed from the document tray 104 is turned over by the document reverse section 103 and is set on the document table glass 9.

Figure 18:
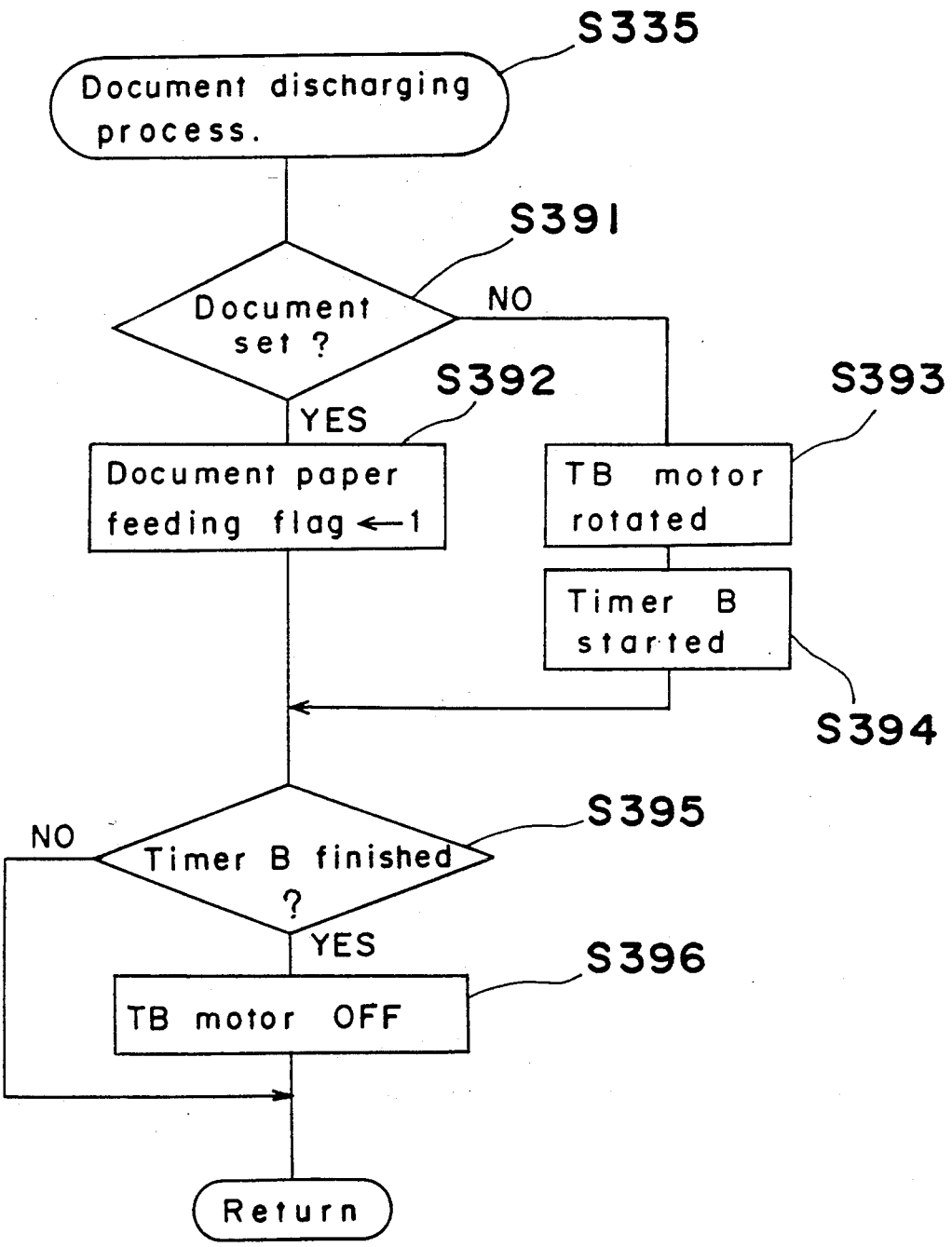
FIG. 18 is a flowchart of a document discharging processing routine shown in FIG. 15*b;*

FIG. 18 shows the document discharging processing routine (step S335) shown in FIG. 15*b*, wherein the document set on the document table glass 9 is discharged to the document discharging tray 111 by the transportation belt 108.

Figure 19A:
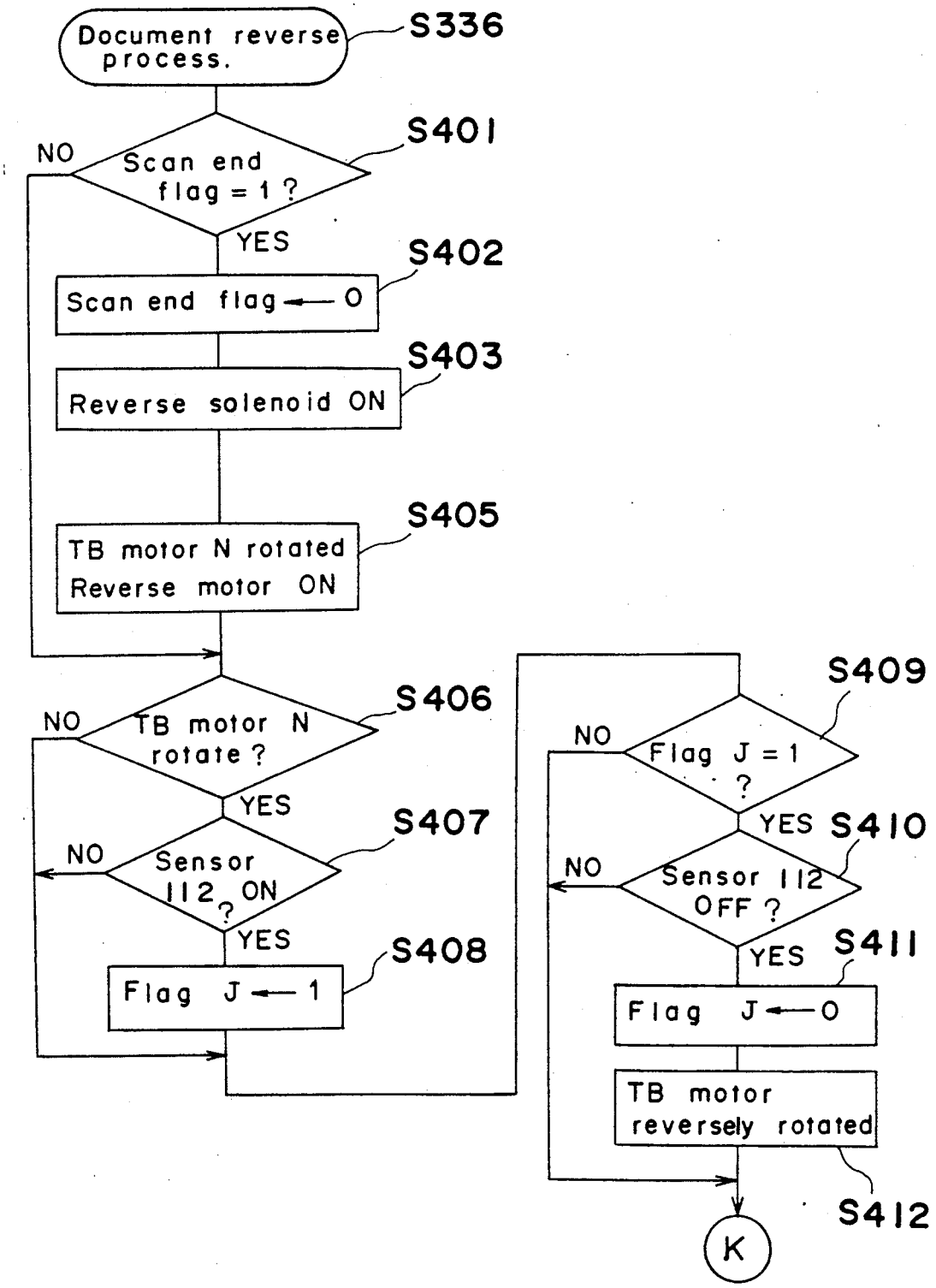
FIGS. 19*a* and 19*b* are flowcharts of a document reverse processing routine shown in FIG. 15*b*.
Figure 19B:
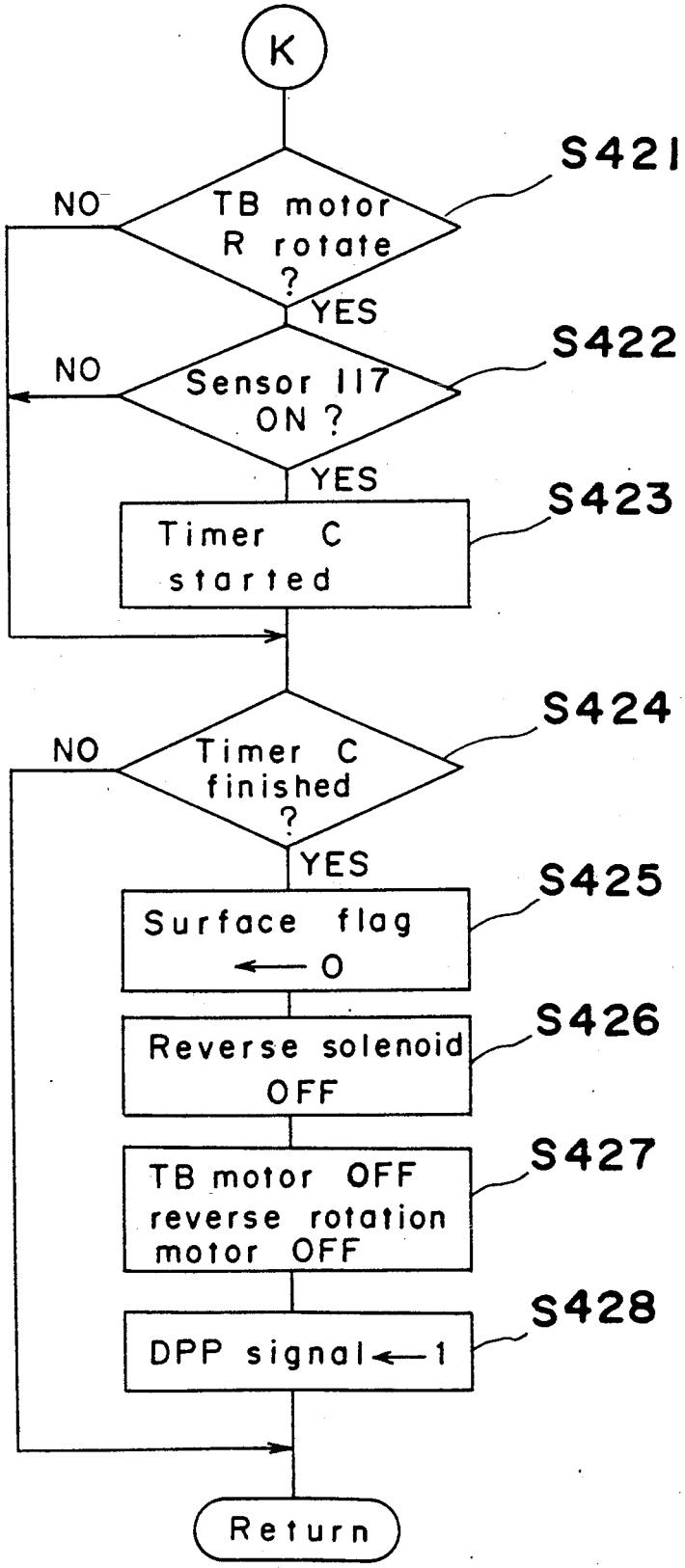

FIGS. 19*a* and 19*b* show the document reverse processing routine (step S336) shown in FIG. 15*b*, wherein the document set on the document table glass 9 is transported to the document reverse section 103, and is turned over by the document reverse section 103 and is set on the document table glass 9 again.

(g) DISPLAY ROUTINE

Figure 20A:
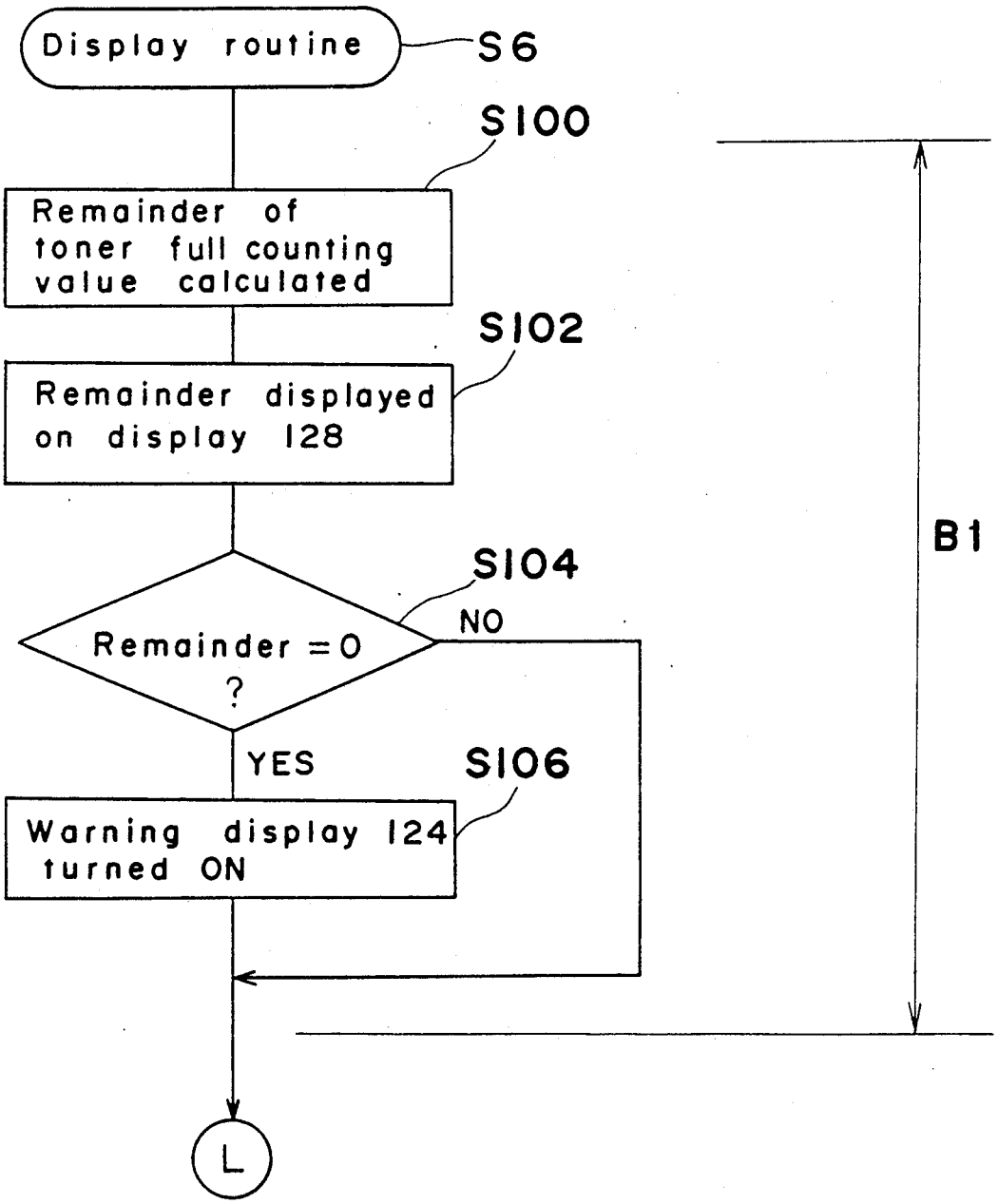
FIG. 20*a* and 20*b* are flowcharts of a display routine shown in FIG. 10.
Figure 20B:
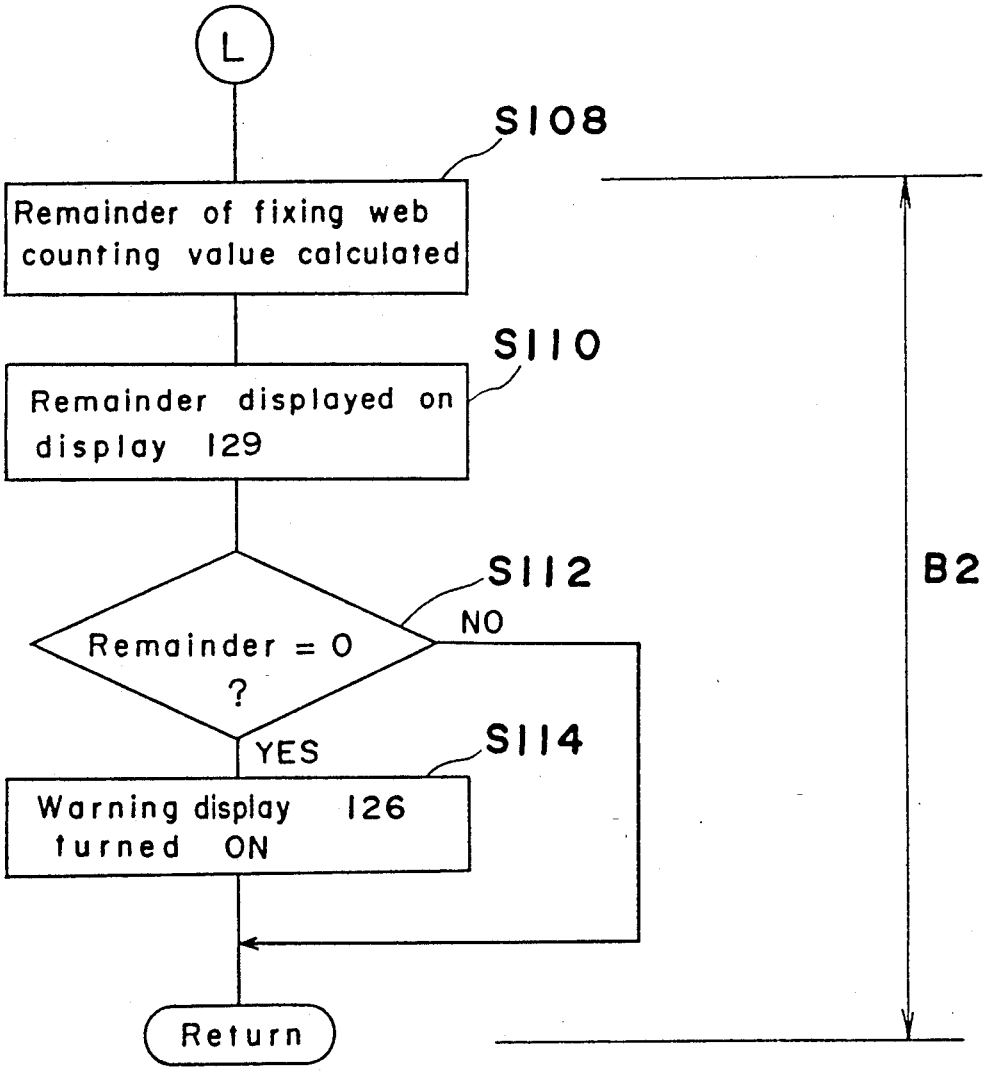

FIGS. 20*a* and 20*b* show the display routine (step S6) shown in FIG. 10.

The display routine is comprised of a first display processing B1 for displaying the remainder of the counting value of the waste toner full counter and turning on the warning display 124 when the copying operation is prohibited, and a second display processing B2 for displaying the remainder of the counting value of the fixing web counter and turning on the warning display 126 when the copying operation is prohibited.

In the first display processing B1, first of all, the remainder of the counting value of the waste toner full counter is calculated at step S100 according to the following equation as described above referring to FIG. 14*a*.

$$T = Ni - Ct, \quad (1)$$

wherein T is the remainder of the counting value of the waste toner full counter, Ni is the number of copies set in the initial setting processing to be obtained until the copying operation is prohibited by detecting that the waste toner container 33 becomes full of the waste toner, and Ct is the counting value of the waste toner full counter.

Thereafter, at step S102, the value T is displayed on the seven-segment display 128 when the both sides document mode is not set, and the value T/2 is displayed on the seven-segment display 128 when the both sides document mode is set in order to indicate that the copying operation will be prohibited after the copying operation corresponding to the number displayed on the display 128 has been performed, and the waste toner container 33 has become full of the waste toner. Therefore, the operator can judge whether or not the copying operation is to be started. If the calculated value T is "0" (Yes at step S104), the warning display 124 for warning the above state is turned on since it indicates that the waste toner container 33 becomes full of the waste toner, and then, the program flow goes to step S108 of the second display processing B2. On the other hand, if the calculated value T is not "0" (No at step S104), the program flow goes to step S108 directly.

Referring to FIG. 20*b*, in the second display processing B2, first of all, the remainder of the counting value of the fixing web counter is calculated at step S108 according to the following equation as described above referring to FIG. 14*a*.

$$W = Ni - Cw, \quad (2)$$

wherein W is the remainder of the counting value of the fixing web counter, Ni is the number of copies set in the initial setting processing, and Cw is the counting value of the fixing web counter.

Thereafter, at step S110, the value W is displayed on the seven-segment display 129 when the both sides document mode is not set, and the value W/2 is displayed on the seven-segment display 129 when the both sides document mode is set, in order to indicate that the copying operation will be suspended during the copying operation corresponding to the number displayed on the display 129 because the cleaning web 43 will be exhausted. Therefore, the operator can judge whether or not the copying operation is to be started. If the calculated value W is "0" (Yes at step S112), the warning display 126 for warning the above state is turned on since the cleaning web 43 will become exhausted, and then, the program flow returns. On the other hand, if the calculated value W is not "0" (No at step S112), the program flow returns directly.

(h) RESET PROCEDURE OF WASTE TONER FULL COUNTER

In the copying machine of present preferred embodiment described above, the procedure for resetting the waste toner full counter can be performed as follows.

(1) If the print key 50 is pressed and the number of copies to be copied is larger than the difference between the value set initially and the counting value of the waste toner full counter, the waste toner full display 124 is turned on at step S1322 of FIG. 14*a*.

(2) After the operator the waste toner is discarded from the waste toner container 33, the mode key 74 is pressed to turn on the LED 136, and thereby, the clearing mode is set at steps S80 to S86 of FIG. 13.

(3) Thereafter, the clear/stop key 62 arranged on first operation panel PLl is pressed (Yes at step S26 of FIG. 11*b*). Then, since the copying operation is not performed, the clearing routine is performed at step S32 of FIG. 11*b*.

(4) Thereafter, as shown in FIG. 12*a*, if the LED 136 is turned on (Yes at step S50) and the front door 48 of the copying machine is opened (Yes at step S52), both the waste toner full display 124 and the LED 136 are turned off at step S54, and the waste toner full counter is cleared at step S56. In this case, as far as the front door 48 of the copying machine is completely closed (No at step S52), the waste toner counter is not cleared, and therefore, the waste toner full counter can be prevented from being cleared by mistake.

In the above preferred embodiment, when not only one side documents are copied but also both sides documents are copied, the suspension of the copying operation is detected and warned previously before starting the copying operation. Therefore, the operator can perform a necessary processing before starting the copying operation, and the copying operation can be prevented from being suspended during the copying operation. Furthermore, the working efficiency in the copying operation can be prevented from decreasing.

In the above preferred embodiment, before starting the copying operation, the number of copies which can be obtained until the copying operation is prohibited is displayed. Therefore, according to the displayed number of copies, the operator can easily judge whether or not the copying operation is to be started and a necessary processing for preventing the copying operation from being stopped is to be performed. As the result, the suspension of the copying operation during the operation thereof can be avoided effectively, and also the working efficiency in the copying operation can be certainly prevented from decreasing.

(i) OTHER MODIFICATIONS

In the presently preferred embodiment, the mode keys 74 and 75 for clearing the waste toner full counter and the fixing web counter, respectively, are arranged on the second operation panel PL2, however, the mode keys 74 and 75 may be arranged on the first operation panel PLl, and also may be arranged on the outside portion of the front door 48 which is opened upon discarding the waste toner accommodated in the waste toner container 33.

In the presently preferred embodiment, the up counters are used as the waste toner full counter and the fixing web counter, respectively, and the counting values thereof become zero when reset. However, down counters may be used as the waste toner full counter and the fixing web counter. In this case, predetermined initial values are set in respective down counters when they are reset.

Furthermore, in the presently preferred embodiment, it is detected and warned previously before starting the copying operation that the waste toner container 33 will become full of the waste toner or the cleaning web 43 will be exhausted. However, it may be detected and warned previously that other consumptive parts or materials such as copying papers will be exhausted.

Furthermore, in the presently preferred embodiment, the number of documents is input using a set of ten keys 51 to 60, however, a means for automatically counting the number of documents may be provided. For example, in a copying machine comprising a document circulating unit (RDH) wherein each document is scanned by moving each document onto the document table glass in which the scanner is fixed and a multi-copying operation is performed by circulating a group of documents, a larger number of copying papers than that required for copying may have been fed already from a paper feeding unit in such a case that the time interval for feeding the copying papers is extremely short. In order to avoid such inconveniences mentioned above, all of documents are fed and circulated prior to the copying operation in order to count the number of documents. In this case, it becomes unnecessary to input the number of documents to be copied.

The present invention can be applied to not only the electrophotographic copying machine described above but also an image forming apparatus such as a laser printer.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. An electrophotographic copying machine, wherein copying operation is prohibited when consumption of either one of consumptive parts or materials which are used or consumed upon every copying operation reaches a predetermined value, said copying machine comprising:

image forming means for producing copies of documents, said image forming means being operable under a both sides copying mode in which the front and rear sides of each document are respectively copied;

determination means for determining a remainder number of copes to be obtained until said consumption reaches said predetermined value; and display means for displaying a reproducible number of documents, said display means displaying a half of the remainder number of copies as the reproducible number of documents when the both sides copying mode is selected in operation.

2. The electrophotographic copying machine as claimed in claim 1, wherein said display means displays the remainder number of copies as it is when the both sides copying mode is not selected in operation.

3. The electrophotographic copying machine as claimed in claim 1, further comprising:

judging means for judging whether or not the copying operation can be completed to obtain a planned total number of copies that is provided from an operator by comparing said planed total number of copies with said remainder number of copies; and warning means for giving a warning prior to the start of the copying operation when it is judged by said judging means that the completion of the copying operation is impossible.

* * * * *

UNITED STATES PATENT AND TRADEMARK OFFICE

CERTIFICATE OF CORRECTION

PATENT NO. : 5,021,826

DATED : June 4, 1991

INVENTOR(S) : Syuzi Maruta

It is certified that error appears in the above-identified patent and that said Letters Patent is hereby corrected as shown below:

In col. 14, line 28, change "ADP" to -- ADF --.

In col. 16, line 45, after "operator", insert --opens the front door 48 and--.

In col. 18, line34 (claim 1, line 13), change "copes" to --copies--.

In col. 18, line 50 (claim 3, line6), change "planed" to --planned--.

In col 4, line 24, before "view", insert --front--.

In col. 4, line 30, change " periphral" to --peripheral--.

In col. 4, line 33, delete "an".

In col. 4, line 46, change "control" to --operation--.

In col. 4, line 49 change "contort" to -- control--.

In col. 4, line 65, change "prevent" to -- present--.

Signed and Sealed this

Twenty-fourth Day of November, 1992

*Attest:*

DOUGLAS B. COMER

*Attesting Officer*

*Acting Commissioner of Patents and Trademarks*